US010273698B2

(12) United States Patent
Giat

(10) Patent No.: US 10,273,698 B2
(45) Date of Patent: Apr. 30, 2019

(54) CONNECTOR FOR FORM BOARDS AND SYSTEM FOR CAST CONSTRUCTION

(71) Applicant: Yochanan Giat, Jerusalem (IL)

(72) Inventor: Yochanan Giat, Jerusalem (IL)

( * ) Notice: Subject to any disclaimer, the term of this patent is extended or adjusted under 35 U.S.C. 154(b) by 778 days.

(21) Appl. No.: 14/419,481

(22) PCT Filed: Aug. 5, 2013

(86) PCT No.: PCT/IL2013/050664

§ 371 (c)(1),
(2) Date: Feb. 4, 2015

(87) PCT Pub. No.: WO2014/024186

PCT Pub. Date: Feb. 13, 2014

(65) Prior Publication Data

US 2015/0191922 A1 Jul. 9, 2015

(30) Foreign Application Priority Data

Aug. 6, 2012 (IL) ..... 221317

(51) Int. Cl.

| | |
|---|---|
| ***E04G 17/02*** | (2006.01) |
| ***E04B 2/86*** | (2006.01) |
| ***E04B 1/16*** | (2006.01) |

(52) U.S. Cl.

CPC ..... *E04G 17/02* (2013.01); *E04B 1/161* (2013.01); *E04B 2/8658* (2013.01); *E04B 1/165* (2013.01); *E04B 2/8652* (2013.01); *E04B 2002/867* (2013.01); *E04B 2002/8676* (2013.01); *E04B 2002/8688* (2013.01)

(58) Field of Classification Search

CPC ..... E04B 2/86; E04B 2/8611; E04B 2/8617; E04B 2/8635; E04B 2/8647; E04B 2/8652; E04B 2/8658; E04G 17/02; E04G 17/06

USPC ..... 52/508, 513, 506.04, 426; 249/38, 40, 249/42, 190, 191, 213, 216

See application file for complete search history.

(56) References Cited

U.S. PATENT DOCUMENTS 779,288 A * 1/1905 Lane ..... E04G 11/18 249/181
805,819 A * 11/1905 Reichert ..... E04G 9/10 249/108
852,534 A * 5/1907 Wilson ..... E04G 11/02 249/191
858,933 A * 7/1907 White ..... E04B 2/84 52/378
871,879 A * 11/1907 Middleton ..... E04G 17/0658 249/42
878,000 A * 2/1908 Holman ..... E04G 11/18 249/184
897,353 A * 9/1908 Culley ..... E04B 1/4178 52/385
934,061 A * 9/1909 Fincke ..... E04B 1/4178 52/513
937,142 A * 10/1909 Chappelow ..... E04B 1/62 264/253

(Continued)

*Primary Examiner* — Michael Safavi
(74) *Attorney, Agent, or Firm* — Eva Leah Taksel

(57) ABSTRACT

The invention relates to a method for producing cast structures, and a set of connectors for connecting a pair of opposed, spaced apart boards which are useful in said method. A kit of elements useful as support frames in the production of the cast structures is also provided.

4 Claims, 9 Drawing Sheets

(56) References Cited

U.S. PATENT DOCUMENTS 1,429,682 A * 9/1922 Megenity ..... E04B 1/4178 52/379
1,458,034 A * 6/1923 Davin ..... E04G 11/18 249/188
1,616,746 A * 2/1927 Gutridge ..... F23J 11/04 52/513
1,617,033 A * 2/1927 Shields ..... E04B 2/8647 52/306
1,647,685 A * 11/1927 Cooper ..... E04G 11/30 249/155
2,019,236 A * 10/1935 Richter ..... E04G 17/0742 52/127.3
2,046,674 A * 7/1936 Coates ..... E04G 17/0758 249/42
2,057,732 A * 10/1936 Navarre ..... E04G 13/06 249/15
2,099,260 A * 11/1937 Colt ..... E04G 17/0652 249/184
2,358,975 A * 9/1944 Hillberg ..... E04G 17/0721 249/190
3,197,171 A * 7/1965 Michalak ..... E04C 5/168 249/40
3,471,183 A * 10/1969 Fischer ..... E04D 3/3606 411/71
3,786,605 A * 1/1974 Winfrey ..... E04F 13/0853 52/235
3,861,096 A * 1/1975 Emmons ..... E04C 5/168 249/213
3,955,332 A 5/1976 Genis
4,021,989 A * 5/1977 Hala ..... E04F 13/0855 52/235
4,040,774 A 9/1977 Scheller
4,811,537 A * 3/1989 D'Epenoux ..... E04F 13/0855 52/235
5,239,798 A * 8/1993 Saito ..... E04B 2/92 52/235
5,323,578 A * 6/1994 Chagnon ..... E04B 2/8647 249/215
5,634,305 A 6/1997 Erlanger
6,832,456 B1 * 12/2004 Bilowol ..... E04G 9/02 249/190
7,124,547 B2 * 10/2006 Bravinski ..... E02D 27/02 249/191
7,415,805 B2 * 8/2008 Nickerson ..... E04B 2/44 52/309.11
8,348,222 B2 * 1/2013 Lin ..... E04G 17/0658 249/216
8,438,794 B2 * 5/2013 Eickhof ..... E04H 13/006 52/134
8,782,969 B2 * 7/2014 Eickhof ..... E04H 13/006 52/134
2005/0120657 A1 * 6/2005 Titcomb ..... E04G 17/06 52/426
2009/0120027 A1 * 5/2009 Amend ..... E04B 2/8611 52/426
2009/0272876 A1 * 11/2009 McNamara ..... E04G 9/02 249/192
2011/0239566 A1 * 10/2011 Ciuperca ..... B23P 11/00 52/259
2011/0247291 A1 10/2011 Hammon

* cited by examiner 210
211
212
213
215
220
222
223
225
227
228
231
232a
232b
232c
232d
232e
232f
233
239
239a
239b
242
243
245
252
253
255
257
264
265
266
268
280
281
281a
281b
282
283
284
292
293

410
415
414
419
418
417
403
416
402
411
413
412

420

430
436

440
443

450

460
463

470
471
472
474
473
475

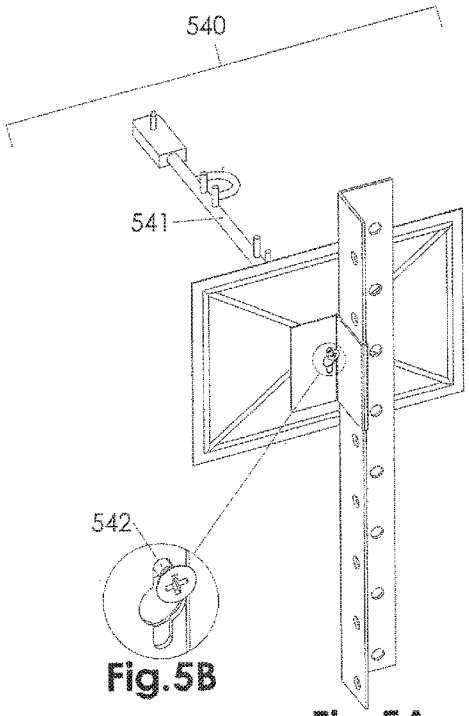
Fig.5A
Fig.5B
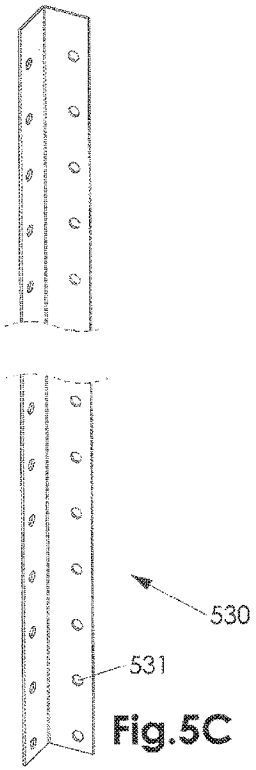
Fig.5C
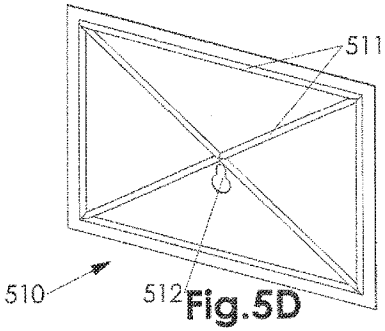
Fig.5D
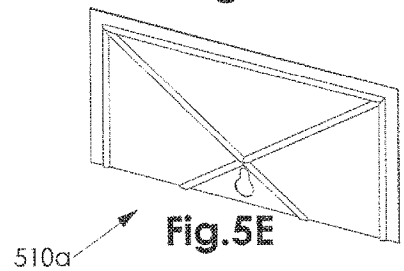
Fig.5E
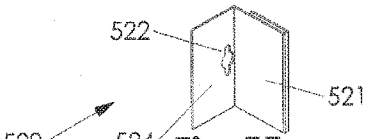
Fig.5F

CONNECTOR FOR FORM BOARDS AND SYSTEM FOR CAST CONSTRUCTION

FIELD OF THE INVENTION

The present invention relates generally to tools, methods and systems for constructing cast structures including walls, ceilings, columns and beams, and more specifically to tools, methods and systems for accurate construction of multilayer cast structures.

BACKGROUND OF THE INVENTION

There are many methods and systems of constructing walls in the construction industry. Some methods involve the connection of pre-fabricated walls. Other methods involve time-consuming for laying of brick walls.

Cast structures, e.g., walls, can be constructed by placing two spaced apart panels in parallel to each other, affixing said panels in their positions by means of suitable support means, pouring unhardened concrete into the space between said panels and allowing the concrete to cure. The panels may be either removed or remain in their place, and in the latter case, they may be designed to serve useful functions, such as thermal insulation. The resultant wall may be coated with plaster and/or stone.

IL 124209 describes a building method using a plurality of framework elements for engaging and retaining vertical plates, and at least one sheet of rigid foamed insulation.

US 2001/0027631 describes the construction of a concrete structure, using two opposed longitudinally-extending side panels, with a web member partially disposed within each of said panels, and connectors placed between the side panels for connecting the web members to each other.

US 2004/0035073 discloses a three-dimensional construction module supported by mesh layers oriented transversally and longitudinally.

One prior art method of constructing a standard cast wall, which may be plaster and/or stone coated and thermally insulated, requires many stages. This general methodology is prevalent in Israel and in the Middle East, in forming outer walls which have at least one outer layer of "Jerusalem limestone". These many stages, performed by several different professional workmen, include: formwork preparation, metal reinforcement preparation, concrete casting, form dismantling, scafolds erection, waterproofing, applying thermal insulation, supporting the external coating stones by anchoring metal nets, stones cutting, stone drilling, stone laying, cementing the spaces between the stones, wall-face planarization, scaffolds dismantling, exterior wall cleaning, interior wall cleaning, thermal insulation preparation, (building an additional thin insulation brick wall while placing thermal insulation panels in between the two walls, perimeter construction, interior side plastering (with 3 plaster layers), perimeter dismantling, wall cleaning, and finally, costume-made window and door manufacturing and assembling. This is a stone-coated wall on an external side and plaster-coated on an internal side. Other kinds of walls may be coated on both sides homogeneously either by plaster or by stones, or might be partially or fully uncoated. This type of wall construction is physically very difficult and requires a major logistic effort prior to, during and after the construction process. Not only is this current methodology time-consuming, but is also very expensive. For instance, it requires the transfer of all the large construction equipment, such as plywood, heavy metal forms, large and heavy metal nets, to the construction site using big trucks and heavy duty cranes.

In addition to wall construction, prior art method of construction of a standard cast ceiling, which may be plaster coated and possibly thermally insolated, requires many stages as well. These stages, also performed by several different professional workmen, include: formwork preparation, metal reinforcement, concrete casting, form dismantling, ceiling face planarization, scaffolds erection, interior side plastering with 3 layers plaster, scaffolds dismantling, and finally cleaning.

Furthermore, prior art method of constructing columns and beams requires many stages as well, similar to those performed in building walls and ceilings. In other words, the cast structures, traditionally built in many stages, might be vertical (e.g., walls, and columns), horizontal (e.g., ceilings and beams), or diagonal (e.g., staircases and inclined elements). The multiple stage production of all these structures bears similar disadvantages. Moreover, current construction methods create a lot of dust, ground material and lead to both airborne and solid pollution.

SUMMARY OF THE INVENTION

The invention relates to the production of cast structures which are uncoated, single-sided coated (e.g., a ceiling and an existing wall stone coating) and multiple-sided coated (e.g. walls, columns and beams), for example, a prevalent double-sided coated wall with an internal face and an external face that are coated with plaster and stones, respectively. The casting process is based on a unique method for setting up a support frame and affixing two spaced apart typically parallel boards which constitute the desired final coatings. The other contents of the wall (e.g., reinforcement rods, thermal insulation panel, service conduits and sealants) can be disposed between the two said boards and the concrete is finally poured into the space between the boards. Following the hardening of the concrete, a cast structure is formed, which is optionally reinforced, thermally insulated and sealed, with the desired coatings provided on its outer surfaces.

Thus, board coatings, such as plaster coatings, which are traditionally applied on the hardened concrete upon completion of the casting stage, serve, according to the invention, in place of conventional formwork assembled at the pre-casting stage.

The method, which involves the use of special connectors and construction elements for supporting, assembling and holding the boards, can also be applied for producing single-sided coated or uncoated cast structure, in which case at least one of the boards used is a temporary board (e.g., a plywood board). Following the concrete hardening, the temporary board or boards are removed to obtain an uncoated or one-sided coated cast structure.

Accordingly, the term "board", as used herein, is meant to include any permanently or temporarily used (planar or curved) board. The term "coating board", as used herein, is meant to include any permanently used board for coating the cast structure, e.g., a plaster board, a cement board and a board made of stones. The term "temporary board", as used herein, is meant to include any temporarily used board, e.g., a plywood board (preferably coated with formica), a plastic board and a metal sheet.

As noted above, a first aspect of the invention relates to a device useful in the production of the cast structures, and more specifically, a device for supporting, assembling and affixing two essentially parallel, spaced apart boards in place relative to each other at the stage prior to concrete pouring.

Accordingly, the invention provides a connector for a pair of opposed, spaced apart boards, said connector comprising two opposing ends and an elongate spacer extending therebetween, having at least one substantially horizontal locator member aligned perpendicular to the longitudinal axis of said elongate spacer, said horizontal locator being preferably in the form of a loop, and at least one substantially vertical locator member, extending from said spacer substantially perpendicularly to both the longitudinal axis of said spacer and to said horizontal locator member, said vertical locator being preferably in the form of a pair of cresses or a loop, wherein each of the two opposing ends of said connector is independently selected from the group consisting of:

a. an end suitable for engaging coating boards other than stones board (for simplicity this end is referred to herein as a "plaster head"), said plaster head comprising a plate designed for back supporting said coating board, said plate having a rear side facing said elongate spacer and a front side from which coupling means are longitudinally extended, said means being preferably in the form of a conic head screw, wherein a groove and an expandable rim are preferably positioned between said front side and said coupling means, such that altering the position of said coupling means (e.g. screwdriving said screw) results in the expansion of said rim, b. an end suitable for engaging a stones board (for simplicity this end is referred to herein as a "stone head"), said stone head being preferably wider than said elongate spacer and having an upper face and a lower face, with at least one pin extending vertically from both faces of said end, such that said pin is substantially parallel to the vertical locator (e.g., the pair of cresses), wherein said pin preferably has sharp ends capable of being inserted into corresponding holes in the engaged stones, c. an end suitable for engaging a temporary board, (for simplicity this end is referred to herein as a "concrete head"), said concrete head preferably being thicker than said elongate spacer and having coupling means (e.g., a screw) extending longitudinally therefrom.

The length of said elongate spacer of said connector, which is preferably made of plastic, is in the range from 10 to 2000 mm (more preferably from 150 to 250 mm) corresponds to the thickness of the cast structure.

The diameter of the horizontal loop and similarly, the distance between the pair of cresses extending vertically from the elongate spacer is from 5 to 100 mm, preferably from 10 to 30 mm. Accordingly, the horizontal loop and the pair of cresses can serve as locator for reinforcement rods, which are intended to be threaded therein.

Regarding the plaster head, the useful function served by the expansion of the rim, positioned near the outer surface of the coating board, is that its diameter becomes substantially larger than the diameter of the coating board's hole, thus locking said coating board to said cast structure.

Regarding the stone head, the diameter of the vertical pin provided at the stone head, which pin is typically made of steel, is from 2 to 15 mm (preferably 3 to 5 mm), and it extends by 5 to 50 mm (typically 10-15 mm) from the upper and lower faces of said stone head. The diameter of the plaster head and the concrete head is from 5 to 50 mm (preferably from 8 to 12 mm).

As noted above, the connectors are used for affixing two essentially parallel, spaced apart boards in place relative to each other, defining a space between the boards, into which concrete is to be poured. The connectors, which are provided with a plaster head or a concrete head, are held to the respective boards (e.g., coating boards such as plaster or cement board, and temporary boards such as plywood boards) by means of a plate element (for simplicity this plate referred to herein as a "connector holder"). The plate, which is typically planar and preferably rectangular in shape, is attached to the outer side of the board (the side which is not facing the concrete receiving-space), thereby back supporting the board. The connector holder, e.g., the plate, has a hole similar to that of a keyhole shape, said hole being preferably centrally located in said plate, said hole comprising a first region with a first diameter and a second region with a second diameter, with the first diameter being smaller than the diameter of the head of the coupling member (e.g., the screw) provided in the plaster head or in the concrete head, said first region being preferably provided with reinforcement bend at its margin, and wherein the second diameter being larger than the diameter of the head of said coupling members designed for quick engaging and disengaging said coupling member of said plaster head and concrete head of said connectors.

The dimensions of said connector holder, which is preferably in the form of a thin rectangular metal sheet, are 50-500 mm by 50-700 mm (preferably 100-300 mm by 100-300 mm), and thickness of about 0.1 to 10 mm (preferably 1 to 3 mm). Regarding the substantially centrally located hole of said plate, the diameter of its first region is from 3-25 mm (preferably 4-12 mm) and the diameter of its second region is from 6-60 mm (preferably 10-30 mm). A kit comprising the connector and the connector holder forms another aspect of the invention.

Another aspect of the invention relates to another kind of device useful in the production of a cast structure, and more specifically, a device for producing a coated ceiling, which is coated by a coating board such as plaster board or stones board. Accordingly, the invention provides a connector (480, 490) for supporting said coating board, said connector comprising two opposing ends and an elongate spacer extending therebetween (481), wherein one end (482), designed to be anchored in the ceiling's concrete, is larger than said elongate spacer, and another end consisting of a plaster head or a stone head described above.

Another aspect of the invention relates to another kind of device useful in stone coating an existing wall. Accordingly, the invention provides a connector (4100) comprising two opposing ends and an elongate spacer extending therebetween (4102), wherein one end (4101) consisting of said stone head and another end (4103) consisting of a "C-clamp" head (4106) in the form of a ring with a "V" shape opening in the perimeter of said ring (4105), designed to be clamped on the net anchored to said existing wall.

Another aspect of the invention relates to another kind of device useful in the production of a cast structure, and more specifically, a device for supporting, assembling and affixing two adjacent stones boards typically none co-planar and often orthogonal to one another (for simplicity this connector is referred to herein as "stone corner connector"). Said stone corner connector (SCC) comprises a body and two pins, where said body, having upper and lower faces, comprises two ends and an elongate spacer extending therebetween, where each of the two connector's ends has a pin extending substantially perpendicularly from its faces and essentially parallel to one another, each pin optionally has sharp ends capable of being inserted into corresponding holes in the engaged stones, said elongate spacer has a cress extending substantially upward and an essentially horizontal loop extending laterally, and finally, said body has at least one hole for an engaging element used to engage it to a support frame.

The length of said stone corner connector, typically made of polymeric material such as plastic, is between 20 and 1000 mm (typically 50 to 300 mm), the thickness of said connector, is between 1 and 100 mm (typically 5 to 30 mm), the diameter of each pin, which pin is typically made of steel, and the diameter of said cress is from 2 to 15 mm (preferably 3 to 5 mm), and they extend by 5 to 50 mm (typically 10 to 15 mm) from their faces, and the diameter of the horizontal loop is from 1 to 100 mm, preferably from 2 to 30 mm. Accordingly, the essentially horizontal loop and the essentially vertical cress can serve as locators for reinforcement rod and rim, respectively, which are intended to be threaded therein.

A further aspect of the invention relates to a method for producing cast structures, comprising:

a. assembling at least a pair of opposed, substantially parallel and spaced apart (planar or curved) boards, wherein each board is selected from the group consisting of coating boards and temporary boards, thus defining a filler-receiving-space between the inner faces of said pair of boards, wherein said assembling comprises affixing said pair of boards in place relative to one another by connecting them by means of connectors and holding said connectors by means of connector holders in the form of plates placed on the outer face of each said board, preferably forming an array consisting of rows and columns of said connectors in said filler-receiving-space, wherein each connector comprises an elongate spacer having at least one substantially horizontal locator member aligned perpendicular to the longitudinal axis of said elongate spacer, said horizontal locator being preferably in the form of a loop, such that said loop is normally horizontally aligned in the filler-receiving-space between said pair of boards, and at least one substantially vertical locator member, extending upwardly from said spacer substantially perpendicular to both the longitudinal axis of said spacer and to said horizontal locator member, said vertical locator being preferably in the form of a pair of cresses or a loop, such that said pair of cresses or loop is essentially parallel to said boards,
b. optionally threading horizontal and vertical reinforcement rods through said horizontally and vertically aligned locators of said array of connectors, respectively;
c. optionally disposing in said filler-receiving-space additional contents (e.g., insulation panel, service conduits and sealants) of said structure,
d. pouring filler into the concrete receiving space, and allowing the filler to cure,
e. Optionally removing said connector holders, and when temporary board is used, then removing said connector holders, said temporary board and said coupling members of the corresponding concrete head of each said connector.

Preferably, the step of assembling the boards is preceded by affixing a vertical support frame, comprising vertical and, when necessary, diagonal profiles (e.g., right-angle profiles), mutually connected and optionally anchored to the floor. The method, set out above, may further comprise the step of disposing any additional contents of said cast structure (e.g., thermal insulation panels, service conduits and sealants) in the space between the pair of boards prior to filler addition.

There is also provided, according to one embodiment of the present invention, a coated wall comprising:

a. At least one pair of spaced apart, typically parallel, boards, wherein at least one board constitutes the desired final coating board made of e.g. plaster board, stones board or cement board,
b. A plurality of substantially horizontal connectors placed between said pair of boards and affixing said boards in place relative to one another, wherein each of said horizontal connectors comprises a pair of elements (locators) for positioning reinforcement rods (e.g. metal rods), said locators being oriented in planes which are perpendicular to one another, said connectors being preferably in the form described in detail above;
c. Optionally, reinforcement rods (e.g. metal rods) disposed between said boards forming a grid structure held in place by means of said connectors;
d. Optionally, sealant and/or other contents of said wall (e.g. insulation panels and service conduits) being placed between said boards,
e. Optionally, filler adapted to be poured into the gap between said boards and to set therein.

In those cases where an opening of any shape needs to be provided in the cast structure, e.g. a rectangular window, then the invention further comprises assembling a frame of boards (e.g. marble stones), each being orthogonal to said coating boards and covering the thickness of the cast structure and a lintel, and casting a beam (preferably with reinforcement rods) on top of them, and when necessary, establishing an access for filler beneath the opening (e.g. the window) using at least one pipe serving as a funnel in order to fill the entire space beneath said opening by said filler.

Another aspect of the invention relates to a method for producing suspended (planar or curved) cast structures, (e.g., a ceiling and/or a beam) comprising:

a. affixing a substantially horizontal support frame (planar or curved), according to the shape of the desired cast structure,
b. placing on said support frame a (planar or curved) coating board,
c. engaging essentially vertically to said board a plurality of connectors and connector holders described above to said coating board,
d. affixing an additional typically vertical support frame, when side coating is required (e.g., in a coated beam), similar to that used for walls, and tangent to said structure, and engaging typically horizontally a plurality of connectors and connector holders when required,
e. optionally disposing one or more components selected from the group consisting of reinforcement rods and nets, insulated panel, bricks and service conduits of said suspended cast structure, and
f. Pouring filler, and after hardening, optionally removing said support frame, and said connector holders and screwdriving the engaging elements.

Another aspect of the invention relates to a method of applying a stone coating on an existing wall, comprising:

a. anchoring to said wall a net, preferably in the form of a grid of metal rods,
b. assembling a stones board using stone net connectors by means of clipping the net heads of said connectors onto said net, and maintaining filler-receiving-space between said wall and said stones board, and
c. Pouring filler in said filler-receiving-space.

Another aspect of the invention relates to a kit of elements useful as support frames in the production of the cast structures set forth above, including erected structures (e.g., walls and columns) and suspended structures (e.g., ceilings and beams), said kit comprising:

a. a right-angled profile element (530) in the form of a metal sheet which is bent along its length at an essentially right angle, wherein each of the two parts which are perpendicular to one another has a series of holes (531) along its length, wherein said holes are preferably evenly spaced;

b. a set of longitudinal hollow profiles, each in the form of rectangular parallelepiped in which two opposed lateral edges are open, (for simplicity referred to herein as "hollow profiles"), wherein each individual profile has a cross section which is dimensionally different from the cross section of other profiles in the set, such that said set is capable of being arranged in a first arrangement in which the individual profiles are entirely inserted one inside the other when said set needs to be relocated, shipped and stored, and in a second arrangement in which the profiles are partially inserted one inside the other, when said set is in use;

c. A profile gripping element 520 (for simplicity referred to herein as a "profile gripper") for engaging the connector described above to said right-angle profile (530), said profile gripper comprising a first planar member and in connection therewith at an essentially right angle thereto a second member consisting of two parallel thin plates, said first member comprising an aperture which is preferably located at proximity to the intersection of said first member and one of said thin plates, wherein said parallel plates are spaced apart such that the gap therebetween corresponds to the thickness of a perforated part of said right-angled profile element (530) said aperature is a hole similar to that of a keyhole shape, comprising two kinds of holes, where one kind is circular and larger than the head of the connector's engaging element (e.g. the connector's screw), such hole is desiged for quick engaging and disengaging said coupling means of said plaster head and concrete head of said connector, and a second kind of holes, one above and one beneath the first kind of hole, such holes are elongate and smaller than said head of said coupling element (e.g. connector's screw head), such second kind of holes are designed for enabling gripping said right-angle profile either from its right side of from its left side, while having the weight of said profile gripper assisting and ensuring its locking effect to the engaging element;

d. a wedge insertable in the gap formed between a pair of said profiles, when said profiles are in said second arrangement, said wedge being positioned between the inner face of the lower base of the wider profile and the outer face of the lower base of the narrower profile, thereby attaching the upper bases of said profiles to one another; and e. a flexible cable, preferably having two solid, (e.g. T-shaped), heads at its ends, such that each heads is capable of being inserted through a hole of said right-angle profiles and cancatinate each two adjacent profiles by essentially two typical spaced apart cable spacers, thus typically evenly spacing apart said profiles when used, and keeping them both cancatinated and stocked together when orderly relocated, shipped and stored.

The right-angle profile, which is preferably made of a metal sheet, is 10-10000 mm by 10-100 mm (preferably 300-5000 mm by 30-60 mm);

Said profile gripper is typically made of sheetmetal, and the dimensions of each of its members is 20-200 mm by 20-200 mm (preferably 30-100 mm by 30-100 mm);

The set of said hollow profiles, typically rectangular metal, of dimensions 10-200 mm by 10-200 mm (preferably 20-100 mm by 20-100 m);

The wedge is typically made of 8-100 mm by 8-100 mm by 8-100 mm steel;

The cable, typically made of steel, is 20-200 mm long and 0.5-10 mm (usually 1-3 mm) thick.

Another aspect of the invention relates to a method for using said support frame kit for establishing support systems for the construction of cast structures by:

1. assembling the coating boards for erected structures (e.g., walls and columns) which is usually preceded by affixing a series of spaced apart (e.g. by 120 cm) vertical support profiles, comprising of vertical and, when necessary, diagonal right-angle profiles, mutually connected and preferably anchored to the floor, said cast structure is usually fastened to said vertical support profiles by means of the profile grippers; and, 2. assembling the coating boards for suspended structures (e.g., ceilings and beams), which is usually preceded by establishing essentially a horizontal support frame including:

a. disposing hollow profiles (serving as support frame beams), typically parallel to one another and spaced apart (e.g., by 1 meter), on top of standard construction jacks, e.g. narrower profiles partially inserted into wider ones, where each set of overlapping parts are optionally commonly supported by a jack, and where a wedge is inserted between them at their bottom faces in order to insure that their upper parts are mutually attached to one another, or alternatively, supporting said narrower hollow profile by a jack near said overlapping regions and having the wider profile suspended on the narrower one, b. disposing right-angle profiles on top of said hollow profiles, spaced apart (e.g., by 10 cm) by at least two typically identical cable spacers connecting each two adjacent profiles, and having said profiles oriented, for example at a v-shape (for maximizing the support area of the coating board disposed on top of them), said right-angle profile partially overlaps longitudinally an adjacent one extended longitudinally, where each pair of overlapping parts are supported by a hollow profile.

Another aspect of the invention relates to a method of using said support frame kit for supporting wall-to-ceiling connection, which includes the following steps used, for instance, for stone-plaster wall when connected to plaster coated ceiling:

a. connecting horizontally a right-angle profile to said vertical profiles such that one part of this profile is essentially parallel to said stones board while its perpendicular counterpart is perpendicular to said stones board and pointing away from it (for simplicity this horizontal profile is referred to as a "profile rail"), said profile rail is positioned slightly above the top aspect of the ceiling while leaving an opening space between said profile rail and said ceiling's coating plaster board, such opening is left for enabling reinforcement rods and concrete to pass from the ceiling onto the wall, while previously, said vertical profiles are covered by solid sleeves (pipes) at the height of the ceiling, along its thickness, to protect said vertical profiles from being locked by the ceiling's fresh concrete, b. adding an additional row of stones on top of the wall's stones board (for simplicity this row of stones is referred to as a "stone rail"), such stone rail is destined to both prevent the fresh ceiling's concrete from spilling over the wall, and ultimately coat the side of the ceiling, c. Connecting said profile rail to said stone rail using stone-plaster connectors together with profile grippers for gripping said profile rail to withstand the weight of the ceiling's fresh concrete.

Another aspect of the invention relates to a method of using the support frame kit for supporting wall-to-wall connections, which includes the support of each of the two sides of the wall-to-wall right-angle connection, for instance, by said right-angle profile, and fastening them either by metal wires, or by plaster-plaster connector, for instance, or in some cases, e.g. when stone-plaster walls are mutually connected, then stone corner connector (SCC) can be used for the external stone corner, while the internal corner can be supported by the regular connectors, including their corresponding connector holders, provided that these connectors are located close enough to the edge of the internal corner and a narrow connector holder 510*a* is used.

In summary, the present invention deals with an ergonomic strategy and a system of connectors and a kit of elements which enable the performance of all the construction stages of cast structures in one consolidated stage by one single specialist. It is designed to be performed substantially quicker than the prevalent construction methods while saving a lot of human motion and energy. The entire assembling process, according to the invention, can be performed from one side of the cast structure, e.g. the inner side of a building, and it creates almost no residues of construction material. It enables the precise fitting of the openings in a cast structure to the previously manufactured lintels of windows, doors and trellises and not visa versa, thus avoiding the need for custom made production of each window, door and trellises for each opening. The final result of this method is a constructed (planar or curved) unit having the same basic components of the one obtained by the prevalent construction methods, having the advantage of most said coating boards being dis-assembelable and re-assemblable for possible future changes. The construction process here is substantially less time consuming and with less pollution and less manpower—particularly professional expensive one. Therefore, it involves considerably lower costs compare to that of the prevalent construction methods.

BRIEF DESCRIPTION OF THE FIGURES

In the drawings:

FIG. 5A shows assembly of stone-plaster connector, connector holder, profile and profile gripper for constructing cast structures according to an embodiment of the present invention.

FIG. 5B shows a close up view of profile gripper and connector screw assembled according to an embodiment of the present invention.

FIG. 5C shows a profile according to an embodiment of the present invention.

FIG. 5D shows a connector holder according to an embodiment of the present invention.

FIG. 5E shows a corner connector holder according to an embodiment of the present invention.

FIG. 5F shows a profile gripper according to an embodiment of the present invention.

DETAILED DESCRIPTION OF THE INVENTION

The current invention concerns a construction method of cast structures such as walls, ceilings, columns and beams, including devices therefore. More specifically, the invention employs ergonomic strategy for fast and efficient construction of cast structures, using appropriate connectors and tools. These structures are coated with a plaster board and/or stones, or partially or fully uncoated. They optionally include reinforcement grids of horizontal and vertical metal rods, thermal insulation panels, sealants, service conduits and apertures for windows and/or doors. They are typically supported by support frames comprise of vertical, diagonal and, if required, horizontal profiles.

The construction method, according to the invention, is aimed at producing various categories of walls, ceilings, columns and beams as described below:

a. stone-plaster wall—a stone coated wall typically on the outside and plaster board typically on the inside,
b. plaster-plaster wall—a plaster coated wall on both sides,
c. stone-stone wall—a stone-coated wall on both sides,
d. stone-concrete wall—a stone-coated wall on one side whereas the other side is uncoated,
e. plaster-concrete wall—a plaster coated wall on one side whereas the other side is uncoated,
f. concrete-concrete wall—fully uncoated wall,
g. plaster coated ceiling,
h. stone coated ceiling,
i. Partially or fully uncoated ceiling.

Figures 1A, 1B, 1C, 1D:
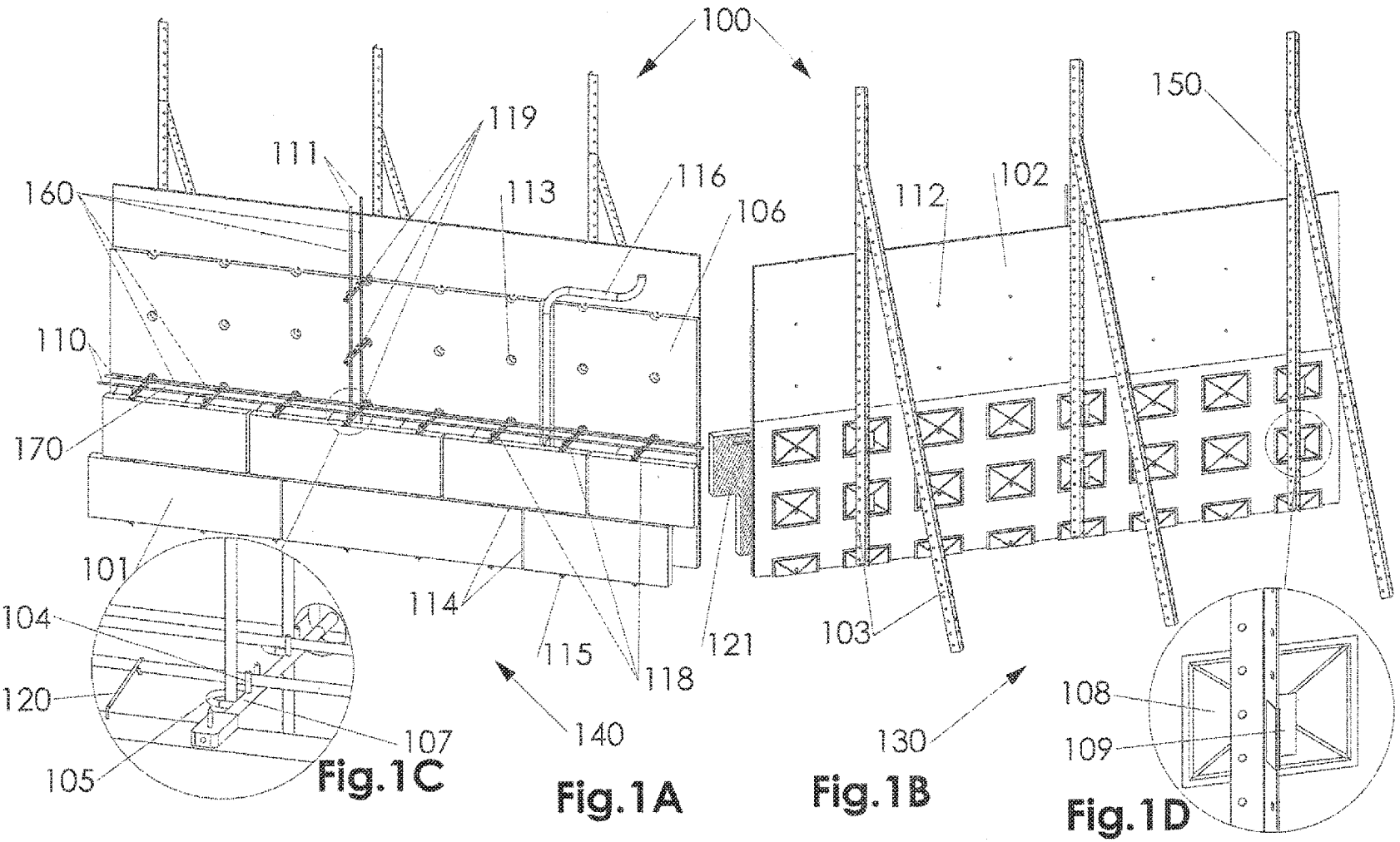
FIGS. 1A-1B show perspective front and rear views of a double-sided stone-plaster wall, in accordance with some embodiments of the present invention.
FIG. 1C shows a close up view of how stone-plaster connector connects stones to plaster board according to an embodiment of the present invention.
FIG. 1D shows a close up view of a connector holder and profile gripper assembly according to an embodiment of the present invention.

Reference is now made to FIGS. 1A-1B, which show perspective front and rear views of the double-sided stone-plaster wall 100, in accordance with some embodiments of the present invention. Wall 100 comprises an internal surface 130 and an external surface 140. Usually, the external surface may be exposed to the environment, and the internal surface is, in some cases, within a building.

External surface 140 is coated with stones 101 and the internal surface comprises, for example, a plaster board 102. The wall may be vertically supported by one or more support frames 103. Disposed between surfaces 140 and 130, there may optionally be a thermal insulation panel 106, which may be attached to plaster board 102. In addition, stone-plaster connectors (SPC) 107, together with connector holders 108, provide connection and support for the plaster board surface and the stone surface. Additionally, profile grippers 109 grip on vertical profiles 150 of the support frames to attach them to the plaster surface. The stone-plaster connectors, connector holders, and grippers 109 are described in more detail herein below in FIGS. 4 and 5. Each row of stone-plaster connectors creates, with their pairs of vertical processes 104, a pair of "virtual horizontal canals" 118 through which horizontal metal rods 110 may be disposed. Additionally, each vertical column of stone-plaster connectors creates, by vertical alignment of their loops 105, a pair of "virtual vertical tunnels" 119, for the positioning of the vertical rods 111. In other words, the processes and the loops of the stone-plaster connectors serve as locators for the metal grids 160.

Each hole 112 in plaster board 102 is typically 10 mm in diameter, which is slightly larger than the diameter of the plaster head 412, which is typically 9 mm (see FIG. 4). Each hole 113 in a thermal insulation panel 106 coincides with its corresponding hole 112 in the plaster board. However, the diameter of holes 113 is much larger, e.g. 40 mm, than that of holes 112. This is designed as such in order to enable concrete 170, or other hardener, upon pouring thereof between the two surfaces 140 and 130, to penetrate holes 113 so that they create short horizontal columns to back-support the plaster board after the concrete hardens. The horizontal distances between holes 112 are usually identical, and the vertical distances between these holes are usually identical. Pins 115 of the stone-plaster connectors may be disposed, for example between a floor and 101, or between two vertically adjacent stones. Service conduits 116, include, but are not limited to conduits for water, sewage, drains, electrical and communication wires and gas. These conduits are disposed between the stone and plaster surfaces. The conduits may optionally be inserted in the thermal insulation panel 106 so that they are more easily removed, added or relocated in the future after the wall has been completed. Spaces 114 may exist between any adjacent stones and may be of around 1 cm. Metal wires 120 can optionally be inserted into additional stone holes and wrapped around horizontal rods 110 to enhance the stone anchoring effect to the concrete. Sealant 121 is typically spreaded or sprayed on the back of stones 101 and in spaces 114 to prevent any penetration of humidity into the wall.

Figures 2A, 2C, 2D, 2E, 2F, 2G, 2H:
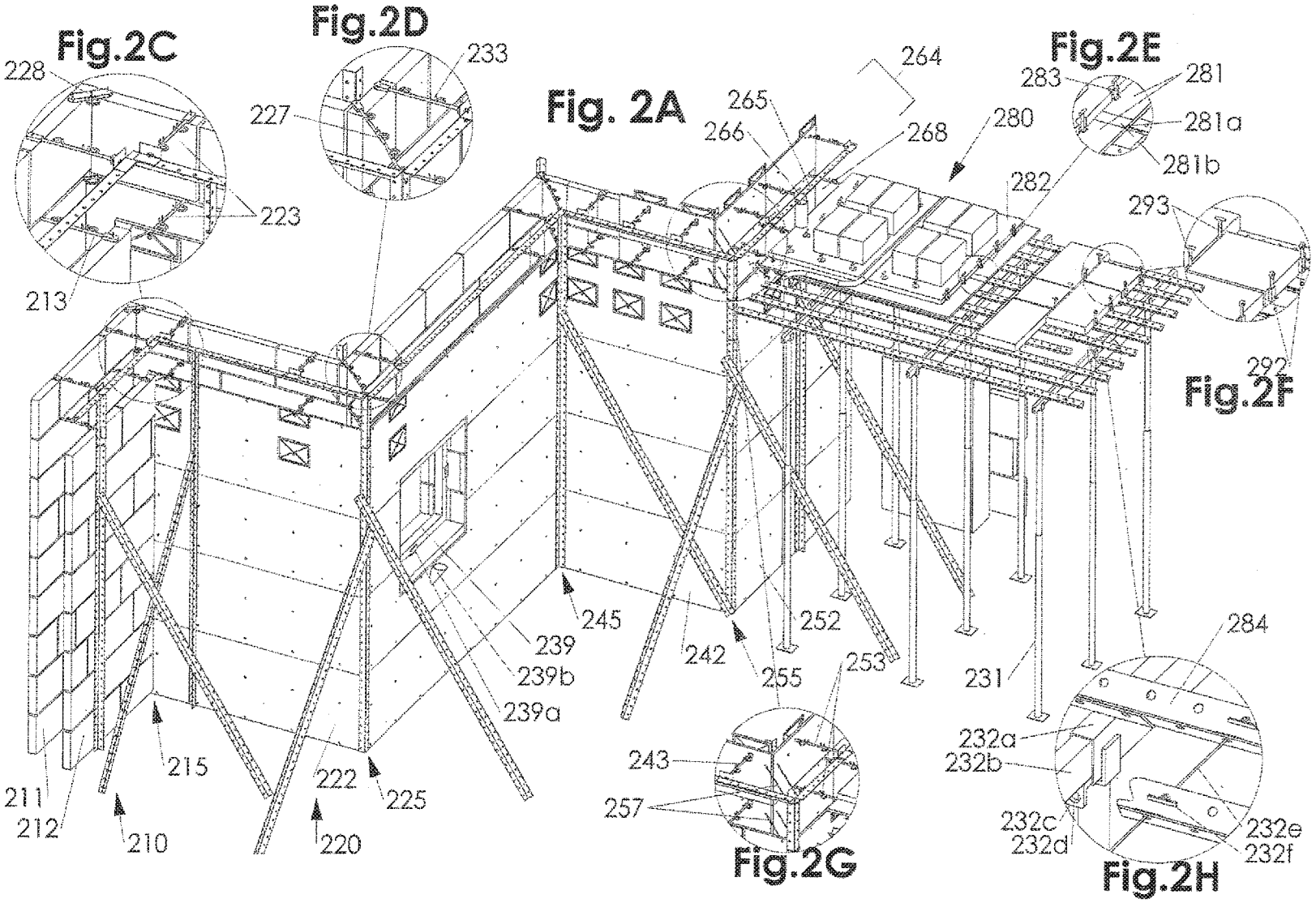
FIGS. 2A-2B show perspective front and rear views of various categories of walls and ceilings, in accordance with some embodiments of the present invention.
FIG. 2C shows a close up view of connectors according to an embodiment of the present invention.
FIG. 2D shows a close up view of connectors assembly at a corner according to an embodiment of the present invention.
FIG. 2E shows a close up view of plaster-ceiling connector assembly according to an embodiment of the present invention.
FIG. 2F shows a close up view of plaster-ceiling connectors assembly around a brick according to an embodiment of the present invention.
FIG. 2G shows a close up view of a plaster-plaster connector and a wire arrangement at a corner according to an embodiment of the present invention.
FIG. 2H shows a close up view of profiles and profile beams supporting a ceiling according to an embodiment of the present invention.
Figures 2B, 2I, 2J:
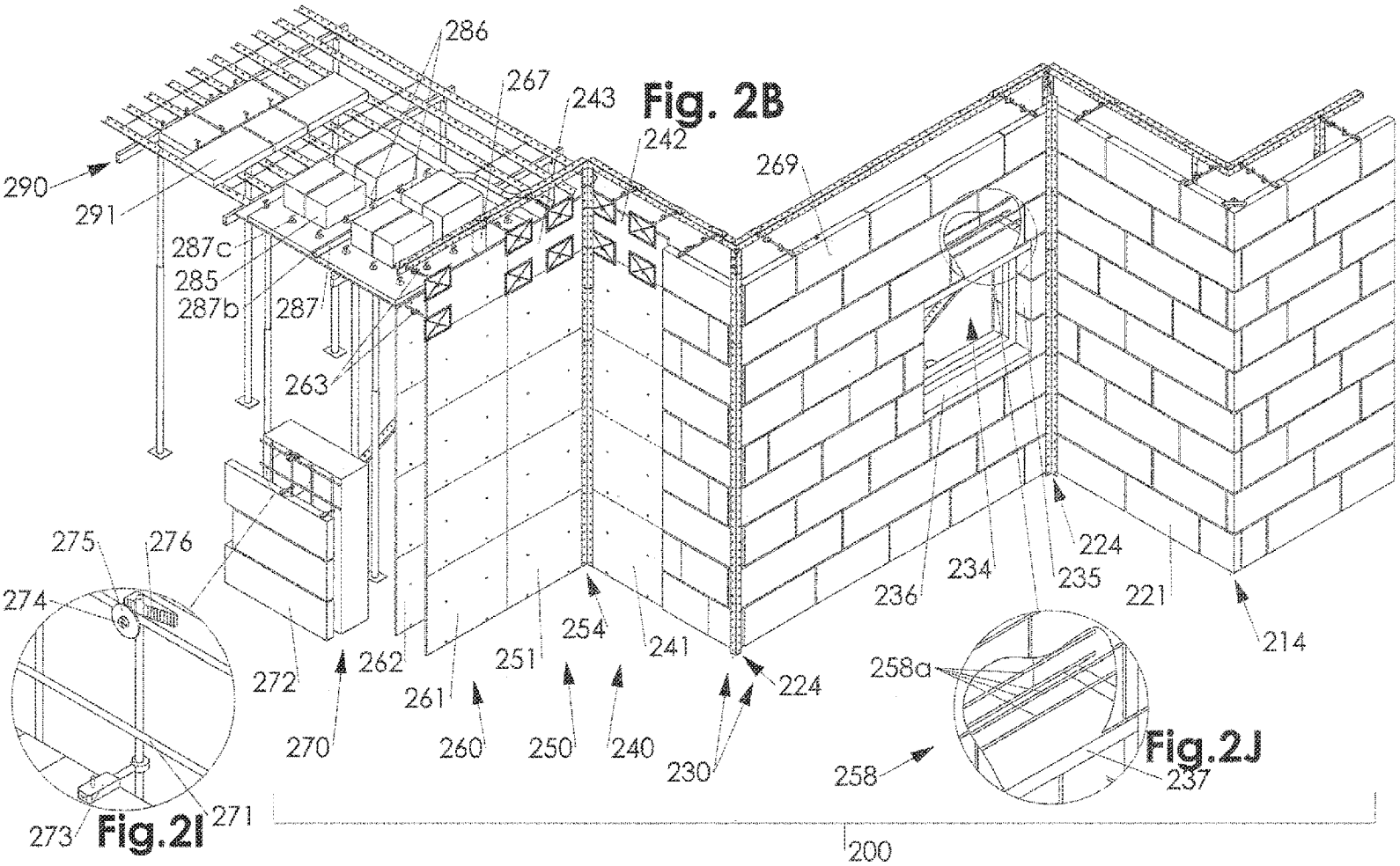
FIG. 2I shows a close up view of a stone-net connector, a wedge, a disc and a bolt assembly according to an embodiment of the present invention.
FIG. 2J shows a close up view of reinforcement rods above a window according to an embodiment of the present invention.

Reference is now made to FIGS. 2A-2B, which show perspective front and rear views of walls 200 and ceilings 280 and 290, in accordance with some embodiments of the present invention.

Double-sided stone-stone wall 210 includes an external stone surface 211 and an internal stone surface 212. This wall is similar to the stone-plaster wall, described in FIG. 1, except that the internal plaster surface 102 (FIG. 1) is replaced here by the stone surface 212, and that the stone-plaster connectors 107 are replaced here by the stone-stone connectors 213, described in further detail herein below in FIG. 4, connector 430.

Double-sided stone-concrete wall 220 comprises an external stone surface 221 and internal removable plywood 222. This wall is also similar to the stone-plaster wall, described in FIG. 1, except that the internal plaster surface 102 (FIG. 1) is replaced here by removable plywood 222, and therefore the stone-plaster connectors 107 (FIG. 1) are replaced here by stone-concrete connectors 223, described in further detail herein below in FIG. 4, connector 460.

Double-sided stone-plaster walls 230 are similar to stone-plaster wall 100 (FIG. 1) and therefore connectors 233 of these walls are similar to stone-plaster connectors 107, described in further detail herein below in FIG. 4, connector 410.

Walls 230 contain window/door aperture 234, in accordance with some embodiments of the present invention. It has a window frame lintel 239. The "lips" of the window aperture include right-angle stones 235, located along the sides of the window frame, and long flat stones 236 and 237 below and above it, respectively. At the internal side of wall 230 at least one concrete feeding hole and funnel 239*b* is used in the plaster board beneath the window frame through which the concrete is poured below the window. In wide apertures of windows or doors, the upper side of lintel 239 and/or stone 237 might bend, or even break, due to the weight of the fresh concrete. In order to avoid such phenomena, pouring the concrete above the window aperture is done in two stages as follows. First, a thin concrete layer (e.g. 10-15 cm) is poured above the aperture and on metal reinforcement rods 258*a* to create beam 258, which is named here an "eye braw". This is done after the part of each right-angle stone 235, coming into the window aperture, is supported firmly from beneath it. And second, after the "eye brow" hardens, the rest of the concrete above the window is poured. It should be noted that, prior to pouring the concrete of the "eye brawn", thin sheet metal spacers 239*a* are placed between lintel 239 and stones 235, 236 and 237. This makes lintel 239 removable after the concrete hardens by, first, removing spacers 239*a*, and then removing lintel 239. However, if spacers 235, 236 and 237 would not be used, then lintel 239 might be locked and not removable after the concrete hardens.

Double-sided plaster-plaster wall 240 comprises an external plaster surface 241 and internal plaster surface 242. Again, this wall is similar to the stone-plaster wall, described in FIG. 1, except that the external stone surface 101 (FIG. 1) is replaced here by the plaster board surface 241, and hence stone-plaster connectors 107 are replaced here by plaster-plaster connectors 243, described in further detail herein below in FIG. 4, connector 420.

Double-sided plaster-concrete wall 250 includes external removable plywood 251 and an internal plaster board surface 252. This wall is similar to the stone-plaster wall, described in FIG. 1, except that the external stone surface 101 (FIG. 1) is replaced here by the removable plywood board 251, and that the stone-plaster connectors 107 are replace here by plaster-concrete connectors 253, described in further detail herein below in FIG. 4, connector 450.

Double-sided concrete-concrete wall 260 includes external removable plywood 261 and also internal removable plywood 262. This wall is, again, similar to the stone-plaster wall, described in FIG. 1, except that both external stone surface 101 and internal plaster surface 102 are replaced here by removable plywood boards 261 and 262, respectively, and therefore stone-plaster connectors 107 are also replace here by concrete-concrete connectors 263, described in further detail herein below in FIG. 4 connector 440.

The connections between walls 200 include two types of corners: internal corners 215, 224, 245 and 254, and external corners 214, 225, 224 and 255. Frequently, connections between walls are supported here by a profile at the internal corner, and another profile at the external corner, which are fastened to one another by a connector and/or a wire (see, for instance, 227 and 257, respectively). In some cases, internal corners can be supported by the regular connectors, appearing at the connected walls, provided that the connectors are located close enough to the edge of the internal corner (e.g. corner 215). In other cases, external stone corner can be supported by external stone corner connector 228, described in further detail herein below in FIG. 4, connector 4120.

Wall 270 is an existing wall, which is supposed to be coated by coating stones 272. Stone anchoring net 271 is anchored to wall 270 by bolts 274 and discs 275. Wedge 276 is used to help level the net in the desired plain, typically but not necessarily, vertical. Stones 272 are anchored to net 271 using stone-net connectors 273, similar to that described in further detail herein below in FIG. 4, connector 4100.

Reference is now made to ceilings 280 and 290 in FIGS. 2A-2B, in accordance with some embodiments of the present invention. Ceilings 280 and 290 sit on a pergola assembly comprising of jacks 231, profile beams 232*a* and 232*b* and profiles 284, including wedges 232*c* and cable spacers 232*e*. Jacks 231 are standard jacks used in the field of construction, where their heights are adjustable. Profile beams 232*a* and 232*b* are typically hollowed rectangular profiles. They are similar in dimensions while one can be inserted inside the other. For instance, profile beams 232*a* and 232*b* can be of 60×30 and 50×25 mm hollowed rectangular profiles, respectively, with wall thickness of around 1.5 mm. Thus, profile beam 232*b* can be entered into profile beam 232*a* while wedge 232*c* is inserted in between them to compensate for the few millimeter difference in their width to assure that their top aspects reach similar height. Note that beneath the overlapping parts of each pair of beams (and wedge 232*c*) jack 231 is placed for reaching maximal strength at the support area. Wedge 232*c* has hole 232*d* for anchoring cables to laterally support beams 232*a* and 232*b*, typically anchored to the floor or to a neighboring beam. Safety pin can also be used to connect between each pair of neighboring profile beams.

Typically, profiles 284 are placed orthogonally on top of profile beams 232*a* and 232*b*. Profiles 284 are typically equally spaced, e.g. 15 cm apart from one another, and each one of them is oriented at a "v-shape", in order to have a large interface and support for the plaster board placed on top of them. Thin cable spacers 232*e*, which have solid stoppers 232*f* at their ends, are used for two purposes as follows:

a. fast and easy laying out and folding them on top of the profile beams,
b. Fastening them at their "v-shape" position while maintaining them equally spaced.

Note that the overlapping part of each neighboring profiles 284 must be supported by a profile beam in order to avoid possible collapse.

The selection of such profiles is done because of a number of reasons as described below:

a. Both kinds of profiles are easily overlappable and adjustable to the necessary length and width of the constructed ceiling.
b. They are easily laid out and folded.
c. At their folded and packed positions they are extremely compact and easily moved and/or shipped either inside the construction site or between construction sites.
d. They occupy minimal storage space, in comparison with most of the heavy duty forms and woods traditionally used.

Plaster coated ceiling 280 is viewed here as a sort of horizontal wall, where its bottom face is viewed here as the internal aspect of this "wall". In this view, its internal plaster board surface 281 serves as, sort of, lining, and therefore it is similar to internal plaster board surface 102 of stone-plaster wall, described in FIG. 1, except that stone-plaster connectors 107 are replaced here by plaster-ceiling connectors 283, described in further detail herein below in FIG. 4, connector 480. Just like stone-plaster wall 100 (FIG. 1), supported by profiles 103, optionally thermally insolated by thermal insulation board 106, and its connectors are held by connector holders, also here, ceiling 280 is supported by profiles 284, optionally thermally insolated by thermal insulation board 282, and plaster-ceiling connectors 283 are held by either connector holders or profile gripper at the ceiling's bottom (not seen), described herein below in FIG. 2A. And also the ceiling support arrangement of jacks 231, profile beams 232*a* and 232*b* and profiles 284 is depicted in detail in FIG. 2A as well. Note that edges 281*a* of the two adjacent plaster boards are supported by the same profile, and they are also sealed by tape 281*b* in order to prevent fresh concrete leakage. Bricks 285 are often placed on ceilings, where spaces 286 in between them form the beams and the ribs of the ceiling. Just like in stone-plaster wall 100 (FIG.

1), service conduits 287 include, but are not limited to, conduits for electric and/or communication wires. These conduits are disposed above plaster boards 281 and possibly inside groove 282*a* of thermal insulation board 282, so that they are more easily removed, added or relocated in the future after the ceiling has been completed.

Stone coated ceiling 290 is also viewed here as a, sort of, horizontal wall, where its bottom is the internal aspect (or lining) of this "wall". In this light, again, internal plaster surface 102 in FIG. 1 is replaced here by stone surface 291, except that stone-plaster connectors 107 are replaced here by stone-ceiling connectors 293, described in further detail herein below in FIG. 4, connector 490. Note that the stone-net connector 292 can also be used, particularly when an anchoring net is placed on top of stone surface 291.

Walls 200 contain wall-ceiling connection preparation 264 at the tops of them, in accordance with some embodiments of the present invention. Beyond the tops of walls 200, at their external surfaces, an additional row of stones 269, or plaster boards 243 (or plywood), called external ceiling rail, is assembled. This external rail is connected to (internal) profile rail 265 by any appropriate connectors (according to the kind of the connected wall) and profile grippers 266, which grip on profile rail 265. Each vertical profile of the support frame is protected from the ceiling's concrete by solid sleeve 267. After the ceiling's concrete hardens, each sleeve 267 forms a vertical hole in the ceiling. This hole serves as a passage for lifting support frames (and possibly additional items) for the construction of the next floor, without having to put apart the support frame. Note that there is opening 268 beneath each profile rail 265 since there is no plaster board, plywood or stones against external ceiling rail 269. The role of this opening is to enable the placement of the ceiling's concrete and metal reinforcement rods, coming from the internal side of the wall, to be on top of the connected walls.

Figures 3A, 3C, 3D:
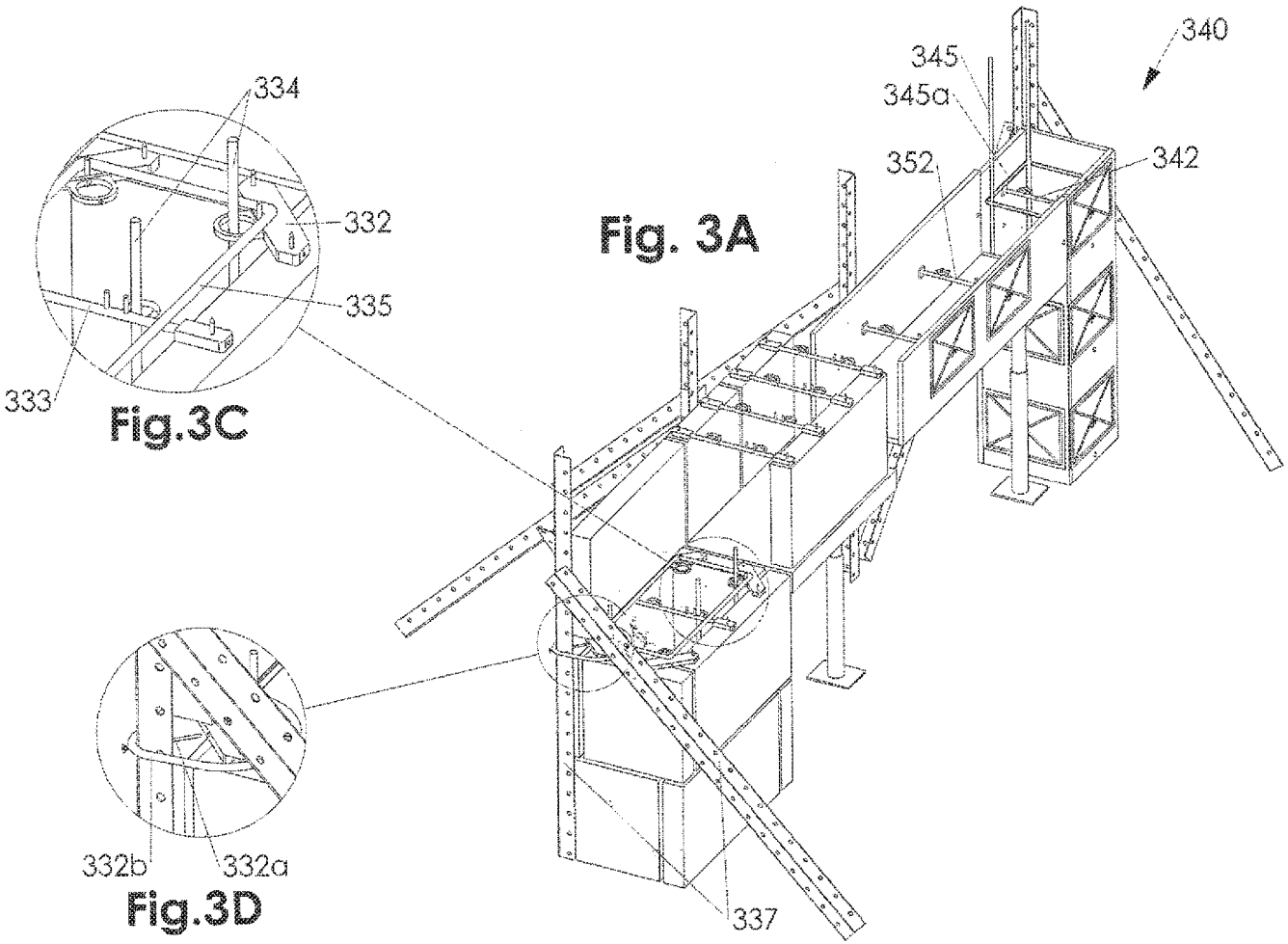
FIGS. 3A-3B show perspective front and rear views of a multi-sided columns and beams, in accordance with some embodiments of the present invention.
FIG. 3C shows a close up view of stone corner connectors and rods assembly according to an embodiment of the present invention.
FIG. 3D shows a close up view of a screw and wire fastening a corner according to an embodiment of the present invention.
Figure 3B:
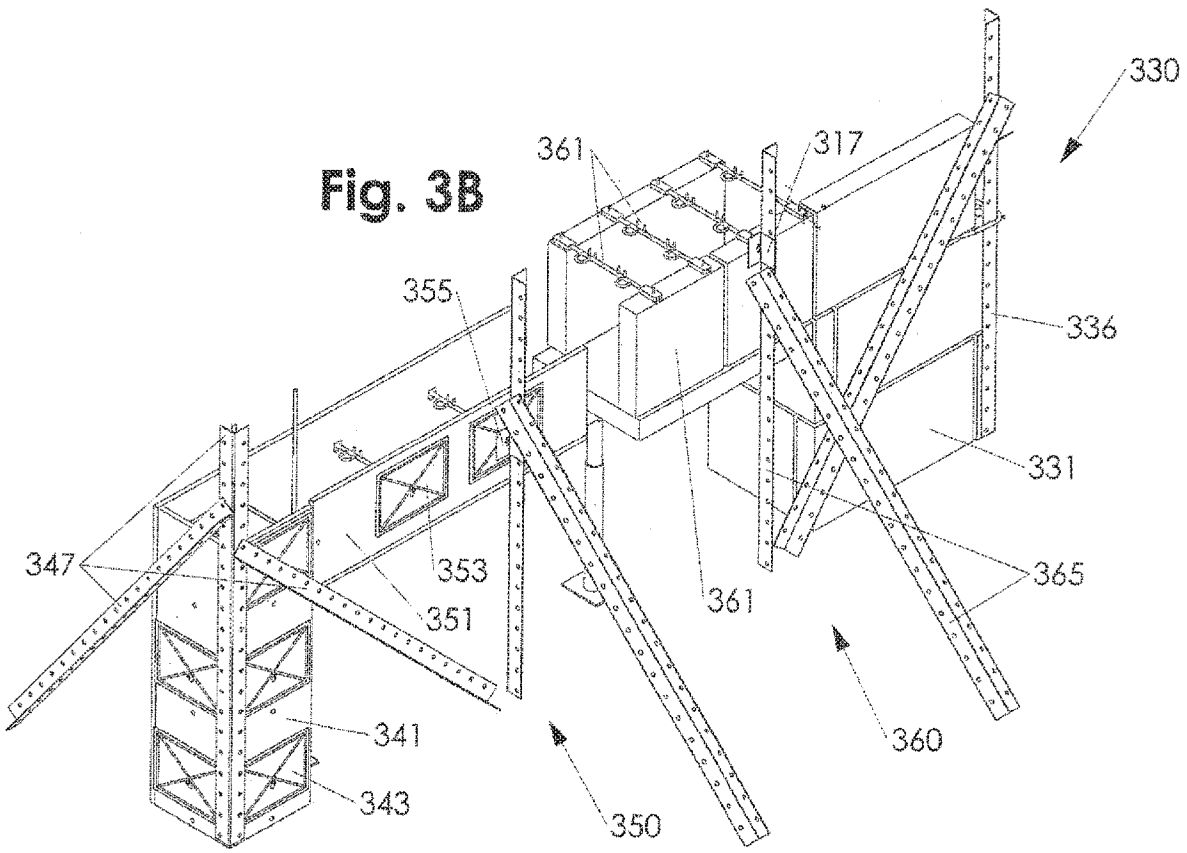
Figures 4A, 4B, 4C, 4D, 4E, 4F, 4G:
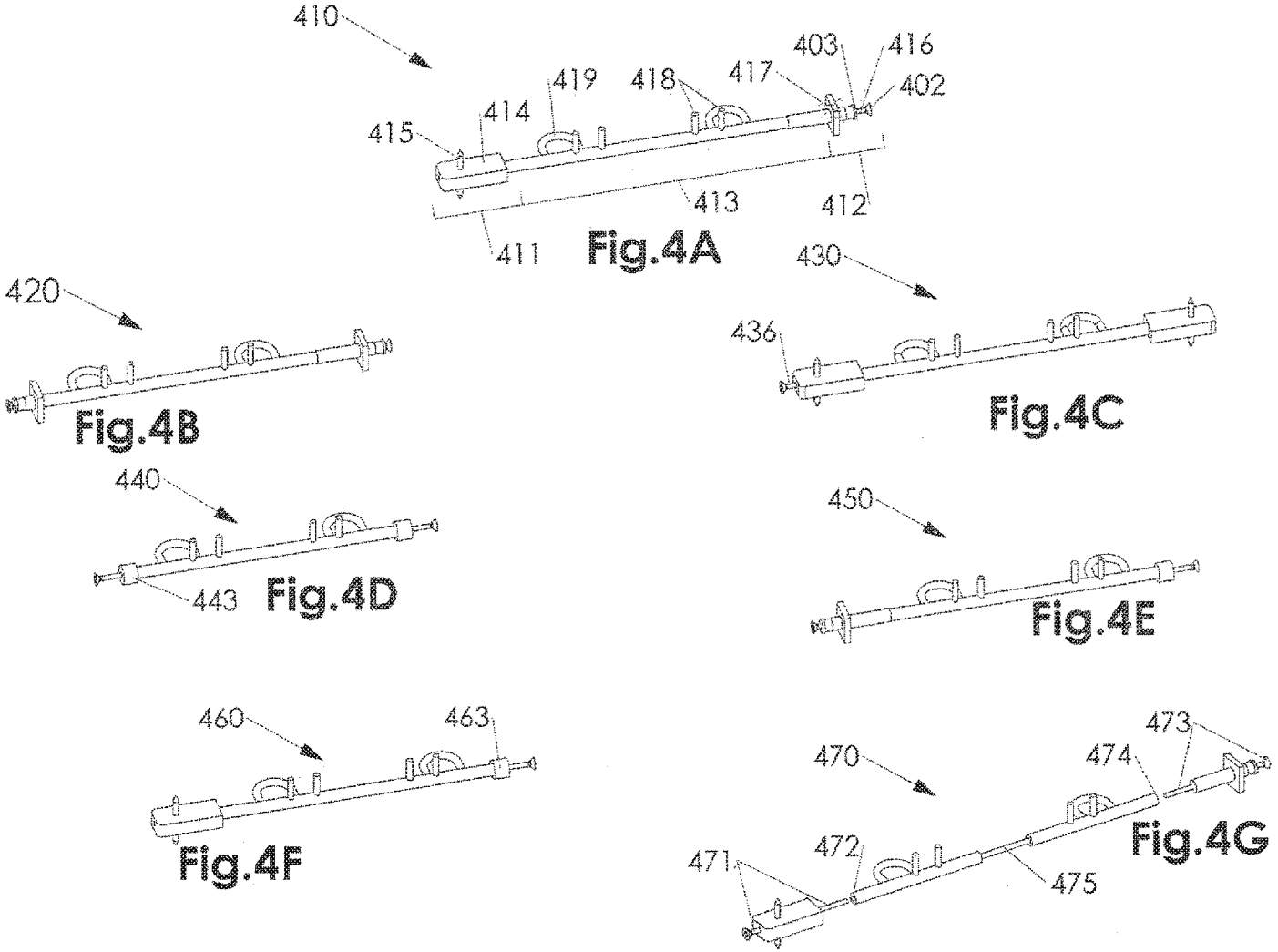
FIG. 4A shows a stone-plaster connector according to the embodiment of the present invention.
FIG. 4B shows a plaster-plaster connector according to the embodiment of the present invention.
FIG. 4C shows a stone-stone connector according to the embodiment of the present invention.
FIG. 4D shows a concrete-concrete connector according to the embodiment of the present invention.
FIG. 4E shows a plaster-concrete connector according to the embodiment of the present invention.
FIG. 4F shows a stone-concrete connector according to the embodiment of the present invention.
FIG. 4G shows a length-adaptable connector according to the embodiment of the present invention.
Figure 4H:
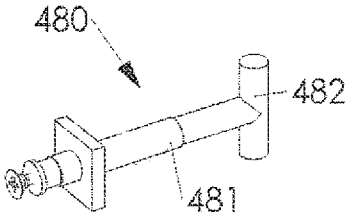
FIG. 4H shows a plaster-ceiling connector according to the embodiment of the present invention.
Figure 4J:
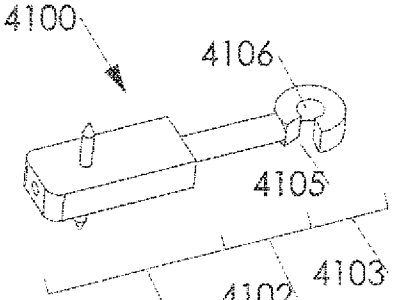
FIG. 4J shows a stone-net connector according to the embodiment of the present invention.
Figure 4L:
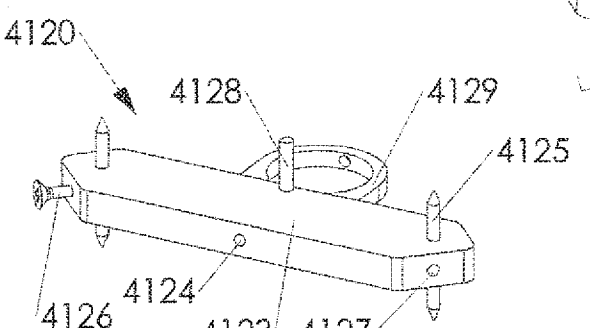
FIG. 4L shows a stone-stone-corner connector according to the embodiment of the present invention.
Figure 4I:
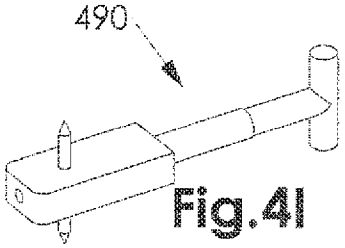
FIG. 4I shows a stone-ceiling connector according to the embodiment of the present invention.
Figure 4K:
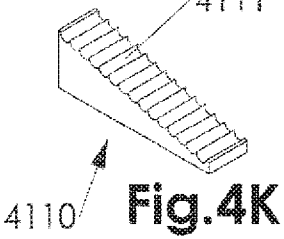
FIG. 4K shows a net wedge according to the embodiment of the present invention.

Reference is now made to FIGS. 3A-3B, which show perspective front and rear views of a multi-sided, columns and beams, in accordance with some embodiments of the present invention;

Reference is now made to plaster coated column 340 and stone coated column 330 in FIGS. 3A-3B, in accordance with some embodiments of the present invention. Columns are viewed here as narrow walls. Therefore, unlike walls 200 described in FIGS. 2A-2B, which are supported at one side only, columns need to be supported at more than one side. Thus, support frames may appear at more than one side and/or their corners as well.

FIGS. 3A-3B show perspective front and rear views of plaster coated column 340. It is supported vertically by support frame 347, and when necessary, additional support frames 354 might be added, together with profile grippers 355, described in further detail herein below in FIG. 5, element 520. Here, plaster-plaster connectors (PPC) 342, connector holders 343 and profile grippers 355 are used to connect plaster boards 341 in the same manner as they are used to connect the plaster surfaces of plaster-plaster wall 240 in FIGS. 2A-2B. Reference numeral 345 represents the metal reinforcement rods, which are assembled vertically, and reference numeral 335 represents the metal reinforcement rims, which are assembled horizontally. Note that plaster-plaster connectors 342 might also connect pairs of vertical profiles, which can also be located at corners, diagonal to one another.

FIGS. 3A-3B also show perspective front and rear views of stone coated column 330. This column is also supported vertically by support frame 337 and, when necessary, additional support frames 365 might be added, together with profile grippers 317. Here, every two adjacent stones 331 are mutually connected by stone corner connector 332, similar to connector 4120 described in FIG. 4. Here, stone-stone connectors (SSC) 333 can be added and used in the same manner as they are used to connect the stone surfaces of stone-stone wall 210 in FIGS. 2A-2B. Also here, reference numeral 334 represents the metal reinforcement rods, assembled vertically, and reference numeral 335 represents the metal reinforcement rims, assembled horizontally. Finally, note that the support frames can be fastened to the stone connectors (either 332 or 333) by screw 332*a*, and/or wire 332*b* and/or profile grippers 317.

Reference is now made to plaster coated beam 350 and stone coated beam 360 in FIGS. 3A-3B, in accordance with some embodiments of the present invention. Beams are viewed and treated here as hybrid structures of both ceilings and walls. Therefore, on the one hand, they are supported by jacks and profiles from the bottom, as ceilings 280 and 290 in FIGS. 2A-2B. And, on the other hand, they are also supported by support frames 347 and 365, similar to walls 200 in FIGS. 2A-2B. More specifically, in plaster coated beam 350, the lateral plaster surfaces 351 are connected to one another by plaster-plaster connectors 352, and connector holders 353, similar to those of plaster-plaster wall 240 in FIGS. 2A-2B, And, in its bottom plaster board, plaster-ceiling connectors (not seen) are used, similar to those used in plaster coated ceiling 280 in FIGS. 2A-2B. Similarly, in stone coated beam 360, lateral stone surfaces 361 are connected to one another by stone-stone connectors 361, similar to stone-stone wall 210 in FIGS. 2A-2B. And, in its bottom stones, stone-ceiling connectors (not seen) are used, similar to those used in stone coated ceiling 290 in FIGS. 2A-2B. Finally, when necessary, the top aspect of beams 350 and 360 are coated right after the concrete is poured. Note that beam 350 can be converted to partially or fully uncoated beam if its plaster boards are removed.

Turning now to FIG. 4, there can be seen various construction connectors for constructing cast structures such as walls, ceilings, columns and beams, in accordance with some embodiments of the present invention.

FIG. 4 shows a perspective view of a stone-plaster connector (SPC) 410, similar or identical to stone-plaster connector 107 (FIG. 1), typically made of a polymeric material. Such material, typically made of a special cross linked high density polyethylene, is used to withstand high mechanical loads for many years at extreme environmental conditions such as plus/minus 110 degrees centigrade. Connector 410 is constructed and configured to which fastens stone 101 and plaster board 102 to the concrete 170 inside wall 100 (FIG. 1). The connector includes three parts: a stone head 411, a plaster head 412, and a body 413. The stone head 411 includes a relatively thick part 414, of around 1 cm in thickness, for bearing the weight of stone(s) 101 and for serving as a spacer between stones, and a sharp pin 415 which is inserted into the stone holes for fastening the stones to the concrete of the wall. Each sharp end of the pin is designed primarily to serve as a guide to ease the insertion of the pin into the stone hole-especially into an aperture 180 (not shown) located at a lower surface of stone 101 (FIG. 1), which are invisible during the assembling process. The plaster head 412 includes a screw 416, having a conic head 402 for fastening the plaster board to the wall, and an end plate 417 for supporting the plaster board from a rear side. The diameter of both the plaster head 412 and that of the screw head is slightly smaller, e.g. 9 mm, than the diameter of the hole in the plaster board, e.g. 10 mm. When the screw is driven into the connector 410, its conic head expands the connector's lips 403 to around 13 mm, which become larger than the diameter of the plaster board aperture hole (10 mm), and this tightens the plaster board to the concrete cast in the wall. The connector's body 413 includes two pairs of vertical processes 418, or more or less, if required, which are configured in parallel to pin 415, and a couple of horizontal loops 419 (or more or less, as required), which are orthogonal to pin 415. The pairs of processes are constructed and configured to aid the placing in position of horizontal metal reinforcement rods 110 there between (FIG. 1) in such a way such that a row of parallel connectors create a pair of "virtual horizontal canals" 118 between processes 418, as is seen in FIG. 1, for the placement of the horizontal metal rods.

Similarly, two loops 419 are designed for positioning the vertical rods 111 so as to form a vertical column of loops thereby creating a couple of "virtual vertical tunnels" 119, disposed to receive the vertical metal rods. In other words, the processes and loops avoid the need to tie the rods for forming metal grids 160

FIG. 4 also shows a perspective view of plaster-plaster connector (PPC) 420, similar or identical to plaster-plaster connector 243 (FIGS. 2A-2B). It connects two plaster boards, such as plaster boards 241 and 242, to the concrete of plaster-plaster wall 240, seen in FIGS. 2A-2B. Plaster-plaster connector 420 is similar to stone-plaster connector 410, except that the stone head is replaced here by the plaster head.

FIG. 4 shows also a perspective view of stone-stone connector (SSC) 430, similar or identical to stone-stone connector 213 (seen in FIG. 2A). It connects two stone surfaces, such as stone surfaces 211 and 212, from both sides of the concrete of stone-stone wall 210 (seen in FIGS. 2A-2B). Stone-stone connector 430 is similar to stone-plaster connector 410 (in FIG. 4), except that its plaster head 412 is replaced here by a stone head, with screw 436 added to it for fastening the connector to a support frame using profile gripper 520 (seen in FIG. 5).

FIG. 4 shows a perspective view of concrete-concrete connector 440, similar or identical to concrete-concrete connector 263 (seen in FIGS. 2A-2B). It connects two thin removable boards, such as removable boards 261 and 262 (typically made of 4 mm thickness plywood, a plastic board or thin sheet metal) to the concrete of wall 260 (seen in FIGS. 2A-2B) in a similar way as stone-plaster connector 107 connects stones 101 to plaster board 102, where connector holder 108 is used (see FIG. 1). However here, the thin removable boards are destined to be removed soon after the concrete hardens, and hence the concrete remains exposed. The diameter of concrete head 443 (typically 13 mm) is greater than the diameter of the holes (typically 10 mm) of the removable board. It is designed as such in order to back support the removable board.

FIG. 4 also shows a perspective view of plaster-concrete connector 450, similar or identical to plaster-concrete connector 253 (seen in FIGS. 2A-2B). It connects a plaster board to a thin removable board, for instance plaster board 252 to removable board 251 in plaster-concrete wall 250 (seen in FIGS. 2A-2B). Plaster-concrete connector 450 is similar to stone-plaster connector 410, except that the stone head of connector 410 is replaced here by the concrete head.

FIG. 4 shows also a perspective view of stone-concrete connector 460, similar or identical to stone-concrete connector 223 (seen in FIGS. 2A-2B). It connects a removable board to a stone surface such as removable board 222 to stone surface 221 of stone-concrete wall 220 (seen in FIGS. 2A-2B). Also here, Stone concrete-connector 460 is similar to stone-plaster connector 410, except that the plaster head is replaced here by the concrete head.

FIG. 4 shows a perspective view of an adaptable connector 470. The components of connector 470 are concatenated by screws 471, 473 and 475. Adaptable connector 470 is often used for various circumstances where the distance varies between the stone plane and the plaster board plane (or the concrete plane). While the two heads here of the connector resemble the stone head and the plaster head of stone-plaster connector 410, depicted in FIG. 4, it is meant to depict here all the permutations of all the 3 various heads (e.g. stone, plaster and concrete), described in FIG. 4.

FIG. 4 shows a perspective view of plaster-ceiling connector 480, similar or identical to plaster-ceiling connector 283 (seen in FIGS. 2A-2B). It connects plaster board 282 (FIGS. 2A-2B) to ceiling 280 in the same manner as stone-plaster connector 107 connects plaster board 102 to the concrete of wall 100 (FIG. 1).

FIG. 4 shows a perspective view of stone-ceiling connector 490, similar or identical to stone-ceiling connector 293 (seen in FIGS. 2A-2B). It connects stones 291 (FIGS. 2A-2B) to ceiling 290 in the same manner as stone-plaster connector 107 connects stones 101 to the concrete of wall 100 (FIG. 1).

FIG. 4 shows a perspective view of stone-net connector 4100, similar or identical to stone-net connector 273 (seen in FIGS. 2A-2B). It is used for stone coating an existing wall (or ceiling) such as wall 270 described in FIG. 2B. Stone-net connector 273, typically made of a polymeric material such as plastic, is constructed and configured to which fastens stones 272 to stone anchoring net 271 depicted in FIG. 2B. Stone-net connector 4100 includes 3 parts: stone head 4101, net head 4103, and body 4102. Stone head 491 is similar or identical to stone head 411 of stone-plaster connector (SPC) 410, depicted in FIG. 4. Net head 4103 is a ring with a "V" shape opening 4105 to enable clipping the connector to the net's wire, which has similar or identical diameter to that of the net's head hole 4106 of the connector.

FIG. 4 also shows a perspective view of wedge 4110, similar or identical to wedge 276 depicted in FIG. 2B. Wedge 4110, typically made of a polymeric material (such as plastic), is used to guarantee that the stone anchoring net 271 is constantly vertical or uniformly inclined in the desired orientation. The circular grooves 4111 have similar or identical radius as that of the wires of stone anchoring net 271, depicted in FIG. 2B. Wedge 4110 is essentially an adaptable spacer between the anchoring net and the existing wall.

FIG. 4 shows a perspective view of a stone corner connector (SCC) 4120, similar or identical to stone-corner connector 228, described in FIGS. 2A-2B. Stone-corner connector, typically made of a polymeric material such as plastic, connects two adjacent stone surfaces 211 and 221 of wall 220, usually at a corner, as described in FIGS. 2A-2B. It is also often used at corners of stone coated columns, such as stone corner connector 332, of stone coated column 330, described in FIGS. 3A-3B. The connector includes a thick body 4123 of around 1 cm thickness, which also serves as a spacer between stones. It typically comprises of two (typically metal) sharp pins 4125, which are inserted into the stone's apertures (not shown) for fastening the stones to each other. The sharpness of each pin is usually designed to serve as a guide to ease the insertion of the vertical pin into the aperture (not shown), especially those located at a lower surface of the assembled stone (which are invisible during the assembling process). Screw 4126 is designed to fasten the stones surface to a support frame using a profile gripper.

The other holes, such as 4124 and 4127 are designed to provide additional possibilities for fastening the connector to supporting profiles. Cress 4128 is designed to guide and hold a horizontal metal rim, such as rim 335 in column 330, depicted in FIGS. 3A-3B. Loop 4129 is designed to guide and hold a vertical metal rod, such as rod s 334, seen in FIGS. 3A-3B. In other words, the cress and loop avoid the need of tying the metal reinforcement rods and rims to each other, as in prior art systems.

Reference is now made to FIG. 5, which shows various construction elements 510, 510*a*, 520, 530 and 540 for constructing cast structures such as: walls, ceilings, columns and beams, in accordance with some embodiments of the present invention.

FIG. 5 shows a front view of connector holder 510. It is typically a rectangular plate, often made of metal. Typical dimensions may be, for example, 20 by 15 cm. In one embodiment, it is made of a sheet metal, and comprises reinforcement support bends or elements 511. This design enables the connector holder to be as light as possible, yet provides significant mechanical strength.

The connector holder comprises of hole 512 of roughly keyhole shape. The hole includes a narrow part of around 5 mm, to hold the neck of the connector's screw 416, described in further detail in FIG. 4, and a wide part, of around 12 mm for quick and easy insertion and receiving of the screw head. Usually, the hole is placed essentially in the center of the plate. However, in some circumstances it is located close to the edge of the plate, e.g. in cases where it needs to be positioned at the edge of the wall. Connector holder 510*a* serves as an example for edge connector holder. An example of its usage can be seen in the bottom row of connector holders of wall 100 (seen in FIG. 1B).

FIG. 5 also shows a perspective view of a profile gripper 520. This plate, typically made of a sheet metal, includes two mutually perpendicular parts, resembling a book end. Part 524 is flat and has a hole 522 of a keyhole shape, similar to or identical to hole 512, except that hole 522 has two, as apposed to one, narrow parts. The narrow parts of the hole are designed to hold the screw of a connector at its neck, and the wide part of the hole serves as a passage for a quick and easy insertion of the head of the screw. Part 521 includes bending of about 180 degrees and it is designed to grip on the profile as depicted in assembly 540. The two narrow parts allow gripping a profile at its either side.

FIG. 5 shows also a perspective view of profile 530, typically made of sheet metal, which is long and bent longitudinally at a right angle with equally spaced holes 531 along its length. It is often used for forming support frames to vertically support cast structures as seen in FIGS. 1-3. It is also used for creating a profile ceiling rail 265 as described in FIGS. 2A-2B, as well as support for ceiling (e.g., profiles 284 in FIG. 2A).

Finally, FIG. 5 shows assembly 540, comprising of connector 541, connector holder 510 and profile gripper 520, which are assembled together with profile 530, to make sturdy assembly 540. Holes 512 of the connector holder and holes 522 of the profile gripper coincide, and through them the screws of the various connectors, shown in FIG. 4 are inserted. The gripping format of the profile gripper is designed as such in order to accommodate various widths of stone. While in stone-plaster wall 100 (FIG. 1), for instance, both the connector holder and the profile gripper are used together, in stone-stone wall 210 (FIGS. 2A-2B), for instance, only profile gripper 520 is used (without connector holder 510).

Figure 6:
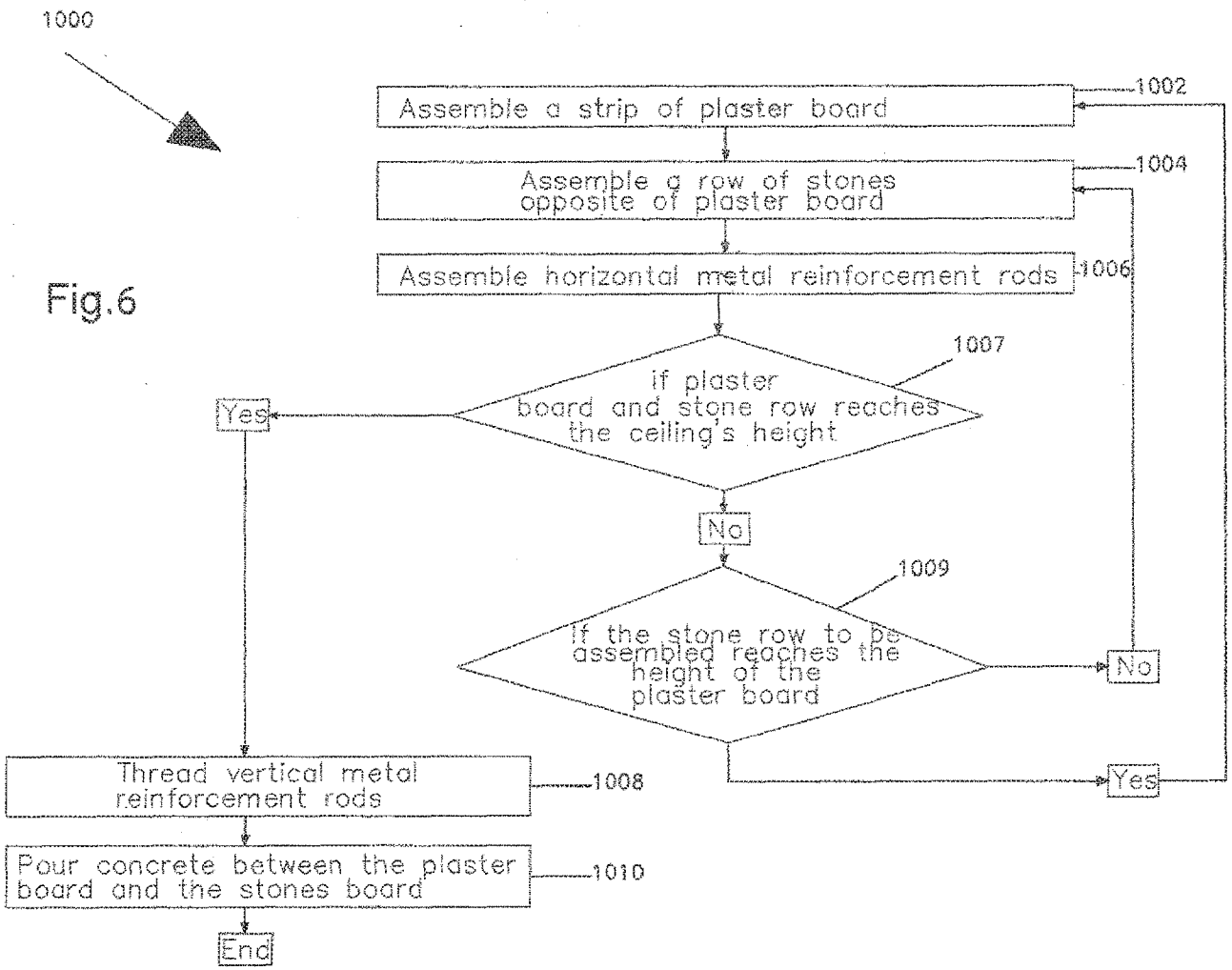
FIG. 6 is a simplified flow chart of a method for constructing a double-sided stone-plaster coated wall; in accordance with some embodiments of the present invention.

FIG. 6 is a simplified flow chart 1000 of a method for constructing a double-sided stone-plaster coated wall 100 described in FIG. 1; in accordance with some embodiments of the present invention.

In a first assembling step 1002, a plaster board is positioned. Prior to this step, the following optional steps may be performed onsite:

Determining Stone's Positions:

a. Numbering stones 101 upon their arrival to the construction site, b. Determining their locations on the wall.

In step 1002, the internal plaster surface is positioned by:

a. drilling plaster board 102, b. attaching to it a support frame 103, using a stone-plaster connector (SPC) 107, connector holder 108 and profile gripper 109, described in further detail in FIGS. 4-5, respectively, and anchoring support frame 103 to the floor, c. optionally attaching thermal insulation panel 106 to plaster board 102, while puncturing it to create holes 113, using plaster board 102 as a model, and then enlarging holes 113 by a drilling cup, d. attaching additional support frames to plaster board 102 using stone-plaster connectors, connector holders and profile grippers, and anchoring them to the floor as well, e. assembling the lowest row of stone-plaster connectors 107 to plaster board 102, using connector holders 108, while the sharp ends of the pins of the stone-plaster connectors 115 are vertical, In a second assembling step 1004, a row of stones is assembled opposite to the plaster surface. This step may entail, for example, the following sub-steps:

a. Drilling each stone 101 of the first row, b. Optionally applying sealant to the surfaces forming the gaps between neighboring stones, c. Positioning each stone against plaster board 102 and insulation panel 106, while inserting pins 115 of the lowest row of stone-plaster connectors into the holes located at the bottom of each, and d. Optionally applying sealant on the back of the stones row.

In a third assembling step 1006, horizontal reinforcing rods 110 are assembled between the two boards assembled in the previous two steps, respectively. Step 1006 comprises the following typical sub-steps:

a. placing a horizontal metal rod 110 at each of the two "horizontal canals" 118, created by the row of stone-plaster connectors 107, b. assembling an additional row of stone-plaster connectors 107 to plaster board 102, using connector holders 108, and inserting their pins into the upper holes of the row of stones, c. Placing additional horizontal metal rod 110 at each of the two "horizontal canals" 118.

In a checking step 1007, the height of the wall is examined as to whether or not it reaches the desired height. If the height hasn't reached the desired one, then we proceed to the additional checking step 1009. In checking step 1009, the height of the row to be assembled is compared to the plaster board height. If it is less than the plaster board height, then steps 1004, 1006 and 1007 are repeated. The following sub-steps may then be performed:

a. drilling an additional row of stones and placing it on top of the previously assembled one, b. assembling an additional row of stone-plaster connectors 107 to plaster board 102, using connector holders 108, and inserting their pins into the upper holes of the row of stones,
c. placing an additional horizontal metal rod 110 at each of the two "horizontal canals" 118,
d. optionally adding any required service conduits,
e. Cementing spaces 114 between any neighboring stones, including adding adhesive sealant in spaces 114.

These sub-steps are repeated until the height of the row to be assembled exceeds the height of plaster board 107. If it does, then step 1002 is added to the assembling process.

This iterative process takes place repeatedly while adding rows of plaster boards and insulation panels at the internal side of the wall, and rows of stones at the external side of it, and placing horizontal metal rods and service conduits in between them, until the desired height of the wall is finally reached. Then, vertical reinforcement rods 111 are threaded through "vertical tunnels" 119, created by the vertically aligned loops of stone-plaster connectors 107, to obtain metal reinforcement grids 160. At the end of this assembling process, a hollowed wall is obtained, which is supported vertically by a row of support frames and is composed of 5 layers: plaster board layer, insulation panel layer, internal metal grid layer, external metal grid layer, and a stones board layer.

In a filling step 1010, the final form of the wall is produced by:

a. pouring concrete 170 into the wall, while using vibration, and waiting for it to harden,
b. dismantling the profile grippers, the support frames, and the connector holders, and
c. Driving the screws of the stone-plaster connectors into the plaster board.

The stone-plaster connectors remain in the wall forever to fasten both the plaster boards and the stone to the cast wall.

At this stage, a stone coated wall on the outside and plaster coated on the inside, is obtained, which is optionally thermally insulated. The internal aspect of the wall is ready for painting while the external aspect is fully completed.

Although FIG. 1 shows a flat wall, this method includes rounded walls as well. In the latter cases, both the plaster board and the connector holders need to be rounded in the necessary curvature and sufficiently short and appropriate stones need to be used. Note that in such cases the distances between the stone holes and those of the plaster board are different.

It should be understood that many permutations and variations on this method are possible and are deemed to be within the scope of this invention.

Preferred Construction Methods and Procedures for Cast Structures

Construction of Stone-Plaster Wall

The construction of stone-plaster wall, in accordance with the present invention, is described in further detail in FIG. 1 and FIG. 6. FIG. 1 describes the components of the wall, including the connectors and elements used to successfully assemble the wall. FIG. 6, however, describes a flowchart, which describes step-by-step the sequential procedure of carrying out the mission of assembling and building a stone-plaster wall.

Construction of Plaster-Plaster Wall

The construction method of a plaster-plaster wall, according to the invention, as described in wall 240 in FIG. 2, is performed similar to that of a stone-plaster wall, and it includes the following typical steps:

1. establishing internal plaster surface 242 as described in the stone-plaster wall construction, using plaster-plaster connectors (PPC) 243, described in further detail in FIG. 4 connector 420, instead of SPC 107 (in FIG. 1),
2. establishing the external plaster surface 241 in a similar manner, and adding horizontal metal reinforcement rods and any required service conduits,
3. assembling the rest of the wall by adding additional plaster boards, Plaster-plaster connectors, metal rods and service conduits,
4. The final construction of the wall is performed as in the stone-plaster wall.
5. Although FIG. 2 shows a flat wall, this method includes rounded walls as well. In the latter cases, the plaster boards, the metal rods and the connector holders can be rounded in the necessary curvatures. Note that in such walls the horizontal distances between neighboring holes in one plaster surface are different from those of the other surface.

Construction of Stone-Stone Wall

The construction method of a stone-stone wall, according to the invention, as described in FIG. 2 in wall 410, is performed similar to that of the stone-plaster wall, and it includes the following typical steps:

1. determining stones' positions, using the computer program,
2. positioning the first drilled internal row of stones 212 on top of a row of stone-stone connectors (SSC) 413, described in FIG. 4 connector 430, while the sharp ends of the connectors' pins are inserted into the holes, located at the bottom of the stones, and the external pins are positioned at the external front of this wall,
3. similarly, connecting the external stone row 411 to stone-stone connectors 413, and then placing a pair of horizontal metal rods on top of stone-stone connectors 413, and connecting to them vertical support frames, using profile grippers,
4. assembling the rest of the wall by adding rows, stone-stone connectors, horizontal metal rods, service conduits, and, at the end, threading vertical metal rods,
5. The final construction of the wall is performed as in the stone-plaster wall.
6. Although FIG. 2 shows a flat wall, this method includes rounded walls, provided that sufficiently short and appropriate stones are used, and the appropriate distances between stone holes are determined.

Construction of Partially or Fully Uncoated Wall

The partially and fully uncoated walls include 3 types of walls as follows (see FIGS. 2A-2B):

a. stone-concrete (concrete means uncoated) wall (e.g., wall 220),
b. plaster-concrete wall (e.g., wall 250), and
c. concrete-concrete wall (e.g., wall 260)

The construction method of a stone-concrete wall, according to the invention, is performed similar to that of a stone-plaster wall, except that here stone-concrete connector 223, depicted in FIG. 4 connector 460, is used.

In this case, the plaster board is typically a thin plywood, plastic board or sheet metal, which is removed together with the connectors' screws that fasten it, after the concrete hardens.

The construction method of a plaster-concrete wall, according to the invention, is performed similar to that of a stone-plaster wall, except that here plaster-concrete connector 453, described in further detail in FIG. 4 connector 450, is used. In this case, the stone plane is replaced here by a thin plywood board, a plastic board or a sheet metal, which is removed, together with the connectors' screws that fasten it, after the concrete hardens.

The construction method of a concrete-concrete wall, according to the invention, is performed similar to that of a plaster-plaster wall, except that here, concrete-concrete connector 463, described in further detail in FIG. 4 connector 440, is used. In this case, the plaster boards on both sides of the wall are typically thin plywood, plastic board or sheet metal, which are both removed, together with the screws of the connectors, after the concrete hardens.

Construction of Wall with Window/Door 1. assembling the wall as described in the stone-plaster wall 230 in FIGS. 2A-2B construction, until the height of the window base is reached,
2. establishing the internal plaster boards at the window level,
3. drilling the stones and assembling them using stone-plaster connectors (SPC) 233, connector holders and, when necessary, profile grippers,
4. drilling and assembling the right-angle stones 235 at the sides of the window frame lintel 239,
5. when the top of the window frame lintel is reached, a drilled stone 237 is assembled, and two or more metal rods 258*a* are placed on top of it, together with a thin layer of concrete, e.g. 10 cm, to strengthen stone 237 together with it's neighboring stone 235 for withstanding the weight of the poured concrete above it in the future,
6. Building the rest of the wall as described in the stone-plaster wall construction.
7. When a door frame lintel is used, then the door frame lintel is positioned on the floor, and the assembling procedure is the same.
8. When plaster-plaster, or concrete-concrete, or plaster-concrete wall is built with window/door aperture, then long marble stones are added to the sides of the window/door aperture in order to fully frame the lintel by stones.

Construction of Ceiling

The construction method of plaster or stone coated ceiling, in accordance with some embodiments of the present invention, is described herein below.

The construction process of plaster coated ceiling 280, described in FIGS. 2A-2B, includes the following typical steps:

1. Positioning jacks 231, profiles beams 232 and right-angle profiles 284,
2. Drilling plaster boards 281, positioning them above profiles 284 while their connection 281*a* is on top of single profile 284, and taping connection 281*a* by tape 281*b*,
3. if necessary, placing thermal insulation boards 282 above plaster boards 281 and creating large holes 287*c*, using drilled plaster boards 281 as a model,
4. When necessary, adding bricks 285, metal reinforcement rods and service conduits 287,
5. Typically connecting ceiling-plaster connectors 283, together with connector holders at the bottom (not seen),
6. Pouring concrete with vibration,
7. After the concrete hardens, removing the connector holders and tightening the screws of ceiling-plaster connectors 283, and
8. Removing jacks 231, profile beams 232 and right-angle profiles 284.

The construction process of stone coated ceiling 290 is similar to that of plaster coated ceiling 280, except that here, coating stones 291 are used. The stones are drilled and assembled in a similar way as stones 101 in FIG. 1 are drilled and assembled. Also here, ceiling-stone connectors 293 are used, in stead of ceiling-plaster connectors 283, together with connector holders (or maybe profile grippers). Note that here, when removing the connector holders, the screws of connectors 293 are removed as well.

Wall-Ceiling Connection

Wall-ceiling connection requires that the metal rods and the poured concrete of the ceiling would be on top of the wall as a one complete continuum. It is also required that this concrete would not be spilled externally beyond the wall. Therefore, an additional row of stones needs to be assembled beyond the height of the wall, which serves as a "peripheral stone rail" for preventing the concrete of the ceiling, when poured, from being spilled. This is performed in the following typical steps (see FIGS. 2A-2B):

1. threading a short solid sleeve 267 through each vertical profile of the support frames, to protect it from the concrete,
2. assembling horizontal "ceiling profile rail" 265 to each vertical profile,
3. connecting the "ceiling stone rail" to the "peripheral profile rail" 243, using both stone-plaster connectors (SPC) and profile grippers 266,
4. If a plaster-plaster wall is built, then the same method is used, except that, instead of a "ceiling stone rail", the external plaster board is used together with plaster-plaster connectors (PPC).

Stone Coating of an Existing Wall

In order to coat wall 270 by stones 272 (see FIG. 2B), stone anchoring net 271 is first anchored to wall 270, using bolts 274 and discs 275. Wedges 276 are used to help level net 271. Then, stones 272 are drilled and assembled on the wall in a similar way as assembling the stones in wall 100, described in FIG. 1, except that here, stone-net connectors 273 are used. Note that typically here the concrete is poured between stones 272 and wall 270 after assembling fewer rows of stones (e.g. one or two) and not necessarily after reaching the top of the wall. Also note that once net 271 is positioned at the required orientation (typically vertical), stone-net connectors 273 make sure that all stones 272 are mutually co-planar as desired.

Construction of Plaster Coated Column

The construction method of a plaster coated column, according to the invention, as described in FIGS. 3A-3B, includes the following typical steps:

1. Cutting and drilling all plaster boards 341,
2. positioning the plaster boards, except one, and attaching them to support frames 347 using plaster-plaster connectors (PPC) 342, connector holders 343, and, when necessary, profile grippers, and anchoring the support frames to the floor,
3. fastening reinforcement metal rods 345 and metal rims 345*a* to the plaster-plaster connectors through the sides of the column where the plaster board hasn't been assembled, and then assembling this missing plaster board, using connector holders 343,
4. Pouring concrete and, after it hardens, dismantling the supporting elements as described in the construction of a stone-plaster wall.
5. For wider columns, more than one column of plaster-plaster connectors needs to be assembled.
6. Although FIGS. 3A-3B shows a rectangular column, this method includes columns of various polygons. It also includes circular and elliptic forms. In the latter cases, the plaster boards, the metal rims and the connector holders should be rounded in the necessary curvature.

Construction of Stone Coated Column

The construction method of a stone coated column, according to the invention, as described in FIGS. 3A-3B, includes the following typical steps:

1. cutting stone 331 to the proper sizes and drilling them,
2. assembling the bottom stone frame using stone corner connectors (SCC) 332, described in further detail in FIG. 4 connector 4120, and fastening it to the support frames, using profile grippers, when necessary, then placing each metal reinforcement rim 335 on top of the SCCs, such that each cress of the SCCs (see FIG. 4 connector 4120) is located inside the rim,
3. repeating step 2 iteratively while filling the spaces between stones with cement and adhesive sealant, until the height of the column is reached,
4. threading each vertical reinforcement rod 334 through the loops of SCCs 332,
5. pouring concrete, and after in hardens, dismantling the support frames,
6. Although FIGS. 3A-3B shows a rectangular column, this method includes columns of various polygons and circular and elliptic forms, provided that the proper stone shapes are used.

Construction of Partially or Fully Uncoated Column

The construction of partially or fully uncoated column requires the replacement of the plaster boards (or stones) of the desired uncoated sides by plywood boards and, correspondingly, using the appropriate connectors that have concrete heads at the desirable uncoated sides of the column. Finally, pouring the concrete in the same manner as previously described, and after it hardens, removing the plywood boards to obtain uncoated sides of the column as desired.

Construction of Beams

The construction process of a plaster coated beam, in accordance with the embodiment of the present invention, is performed in the following steps (see FIGS. 3A-3B):

1. Erecting jacks, placing profile beams on top of them, and positioning right-angle profiles in the appropriate configuration, using the same principles described in ceiling 280, described in FIGS. 2A-2B,
2. drilling the bottom plaster board, placing it on top of the right-angle profiles, and adding plaster-ceiling connectors, together with their connector holders,
3. erecting profile frames 355, similar to that when building wall 100 in FIG. 1,
4. assembling drilled plaster boards 351, using plaster-plaster connectors 352 in a similar manner as assembling plaster-plaster wall, and adding the metal reinforcement rods,
5. pouring the concrete, and adding additional boards on top of the beam, if necessary,
6. After the concrete hardens, removing the support frames, the connector holders, the jacks, and the profiles, and screwing the screws of the various connectors into the plaster boards.

The construction process of a stone coated beam, in accordance with the embodiment of the present invention, is performed in a similar way as the plaster coated beam is done. However, coating stones as apposed to, plaster boards are used. And, of course, the bottom stones are drilled and assembled in a similar manner as stone coated ceiling 290 (described in FIGS. 2A-2B), together with stone-ceiling connectors. The side stones are drilled and assembled in a similar manner as stone-stone wall 210 is built (see FIGS. 2A-2B).

ABBREVIATIONS

SPC—stone-plaster connector
PPC—plaster-plaster connector
SSC—stone-stone connector
SCC—stone corner connector

The invention claimed is:

1. A connector for connecting a pair of opposed, spaced apart boards, said connector comprising two opposing ends and an elongate spacer (413) extending therebetween, optionally having at least one substantially horizontal locator member aligned perpendicularly to the longitudinal axis of said elongate spacer, and optionally having at least one substantially vertical locator member, extending from said spacer substantially perpendicularly to both the longitudinal axis of said spacer and to said horizontal locator member, wherein each of the two opposing ends of said connector is independently selected from the group consisting of:

a. an end (412) suitable for engaging coating boards, said end comprising a plate (417) designed for back supporting said coating board, said plate having a rear side facing said elongate spacer and a front side from which coupling means (416, 402) are longitudinally extended, wherein a groove (403*a*) and an expandable rim (403) are positioned between said front side and said coupling means, such that altering the position of said coupling means results in the expansion of said rim, b. an end (411) suitable for engaging a stones board, said end having an upper face and a lower face, with at least one pin (415) extending vertically from said faces of said end, such that said pin is substantially parallel to the vertical locator, wherein said pin optionally has sharp ends capable of being inserted into corresponding holes in the engaged stones, c. an end (443) suitable for engaging a temporary board, said end being thicker than said elongate spacer and having coupling means extending longitudinally therefrom, d. an end (4103) suitable for engaging a net, said end being a ring with an opening to enable clipping the connector to the net's wire;

wherein at least one of said two opposing ends is said end (412) suitable for engaging coating boards and comprises coupling means in the form of a conic head screw (402).

2. A connector (410) according to claim 1, wherein one end (412) is suitable for engaging a coating board and the other end (411) is suitable for engaging a stones board.

3. A connector according to claim 1, having at least one substantially horizontal locator member aligned perpendicularly to the longitudinal axis of said elongate spacer, and having at least one substantially vertical locator member, extending from said spacer substantially perpendicularly to both the longitudinal axis of said spacer and to said horizontal locator member, wherein the horizontal locator is in the form of a loop (419) and the vertical locator is provided by a pair of processes (418).

4. A connector for connecting a pair of opposed, spaced apart boards, said connector comprising two opposing ends and an elongate spacer (413) extending therebetween, having at least one substantially horizontal locator member aligned perpendicularly to the longitudinal axis of said elongate spacer, and having at least one substantially vertical locator member, extending from said spacer substantially perpendicularly to both the longitudinal axis of said spacer and to said horizontal locator member, wherein each of the two opposing ends of said connector is independently selected from the group consisting of:

a. an end (412) suitable for engaging coating boards, said end comprising a plate (417) designed for back supporting said coating board, said plate having a rear side facing said elongate spacer and a front side from which coupling means (416, 402) are longitudinally extended, wherein a groove (403*a*) and an expandable rim (403) are positioned between said front side and said coupling means, such that altering the position of said coupling means results in the expansion of said rim, b. an end (411) suitable for engaging a stones board, said end having an upper face and a lower face, with at least one pin (415) extending vertically from said faces of said end, such that said pin is substantially parallel to the vertical locator, wherein said pin optionally has sharp ends capable of being inserted into corresponding holes in the engaged stones, c. an end (443) suitable for engaging a temporary board, said end being thicker than said elongate spacer and having coupling means extending longitudinally therefrom, d. an end (4103) suitable for engaging a net, said end being a ring with an opening to enable clipping the connector to the net's wire;

wherein the horizontal locator is in the form of a loop (419) protruding sideways from said elongate spacer and the vertical locator is provided by a pair of processes (418), each process in the form of a pin.

* * * * *